US012215445B2

(12) United States Patent
McGraw

(10) Patent No.: US 12,215,445 B2
(45) Date of Patent: Feb. 4, 2025

(54) SYSTEM AND METHOD OF MANUFACTURING SUSPENSION MEMBER

(71) Applicant: HERMAN MILLER, INC., Zeeland, MI (US)

(72) Inventor: Ethan McGraw, Holland, MI (US)

(73) Assignee: HERMAN MILLER, INC., Zeeland, MI (US)

( * ) Notice: Subject to any disclaimer, the term of this patent is extended or adjusted under 35 U.S.C. 154(b) by 602 days.

(21) Appl. No.: 17/390,396

(22) Filed: Jul. 30, 2021

(65) Prior Publication Data

US 2022/0034006 A1 Feb. 3, 2022

Related U.S. Application Data

(60) Provisional application No. 63/059,461, filed on Jul. 31, 2020.

(51) Int. Cl.

| | |
|---|---|
| ***D03D 15/587*** | (2021.01) |
| ***A47C 7/32*** | (2006.01) |
| ***D03D 1/00*** | (2006.01) |
| ***D06C 7/00*** | (2006.01) |

(52) U.S. Cl.

CPC ..... *D03D 15/587* (2021.01); *A47C 7/32* (2013.01); *D03D 1/00* (2013.01); *D06C 7/00* (2013.01); *D10B 2505/08* (2013.01)

(58) Field of Classification Search

CPC ..... D03D 15/587; D03D 1/00; A47C 7/32; D06C 7/00; D10B 2505/08

See application file for complete search history.

(56) References Cited

U.S. PATENT DOCUMENTS

| | | | | |
|---|---|---|---|---|
| 4,469,739 | A | 9/1984 | Gretzinger et al. | |
| 6,254,190 | B1 | 7/2001 | Gregory | |
| 7,406,733 | B2 | 8/2008 | Coffield et al. | |
| 7,871,131 | B2 | 1/2011 | Rowland et al. | |
| 8,329,281 | B2 | 12/2012 | Coffield | |
| 8,419,135 | B2 | 4/2013 | Moeseneder et al. | |
| 9,462,891 | B2 | 10/2016 | Kikuchi et al. | |
| 2002/0098759 | A1 | 7/2002 | Salway et al. | |
| 2006/0207296 | A1* | 9/2006 | Fujikawa | D04B 21/18 66/202 |
| 2009/0004939 | A1 | 1/2009 | Graichen | |
| 2015/0173514 | A1* | 6/2015 | Kikuchi | A47C 7/32 297/451.9 |
| 2016/0206102 | A1 | 7/2016 | Aldrich et al. | |
| 2017/0355129 | A1 | 12/2017 | McGraw | |

FOREIGN PATENT DOCUMENTS

| | | | | |
|---|---|---|---|---|
| WO | WO-2012162540 | A1 * | 11/2012 | D04B 1/18 |

* cited by examiner

*Primary Examiner* — Daniel McNally
(74) *Attorney, Agent, or Firm* — Michael Best & Friedrich LLP

(57) ABSTRACT

A method of manufacturing a suspension member including providing a first set of yarns and a second set of yarns, combining the first set of yarns and the second set of yarns to form the suspension member, and at least partially bonding a portion of the first set of yarns and the second set of yarns together by heating the suspension member to form a first zone of the suspension member having a first tension.

8 Claims, 28 Drawing Sheets

SYSTEM AND METHOD OF MANUFACTURING SUSPENSION MEMBER

CROSS-REFERENCE TO RELATED APPLICATIONS

This application claims priority to U.S. Provisional Application No. 63/059,461, filed Jul. 31, 2020, the entire contents of which are incorporated by reference herein.

FIELD OF THE INVENTION

The present invention relates to systems and methods of manufacturing suspension material, and systems and methods of manufacturing suspension members having different zones of stiffness.

BACKGROUND OF THE INVENTION

Suspension materials, including textiles and fabrics, are used for numerous products across several different industries. Many pieces of furniture, such as seating structures, are configured with a suspension member in order to support the user on the piece of furniture. For example, suspension material may be placed or stretched across an opening of a furniture frame.

SUMMARY OF THE INVENTION

In one embodiment, the invention provides a method of manufacturing a suspension member including providing a first set of yarns and a second set of yarns, combining the first set of yarns and the second set of yarns to form the suspension member, and at least partially bonding a portion of the first set of yarns and the second set of yarns together by heating the suspension member to form a first zone of the suspension member having a first tension.

In another embodiment, the invention provides a bonding unit for manufacturing a suspension member including at least one heating element configured to heat at least a portion of the suspension member. The bonding unit also includes a feed roller positioned upstream of the at least one heating element proximate an entrance of the bonding unit and a take-up roller positioned downstream of the at least one heating element proximate an exit of the bonding unit. The feed roller and the take-up roller are each configured to move the suspension member through the bonding unit. The bonding unit also includes a controller configured to change the intensity of heat emitted to the suspension member from the at least one heating element.

In another embodiment, the invention provides a suspension member including a first plurality of yarns forming a first zone having a first tension and a second plurality of yarns forming a second zone having a second tension that is different from the first tension, wherein at least some of the yarns in the first zone are fused together.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Various exemplary embodiments are related to seating structures and methods of manufacturing seating structures. Seating structures may include any structure used to support a body of a user, for example, without limitation, task chairs, side chairs, sofas, airplane seats, vehicle seats, bicycle seats, boat seats, beds, dental and medical seats and beds, auditorium and educational seats, etc. It should be understood that the various methods and devices disclosed herein may be applied to seating structures other than a seat and/or backrest, including for example and without limitation armrests, headrests and other ergonomic positioning features. Although the illustrated embodiments are shown in connection with an office chair, other embodiments can include different configurations.

Method of Manufacturing Suspension Member

Figure 1:
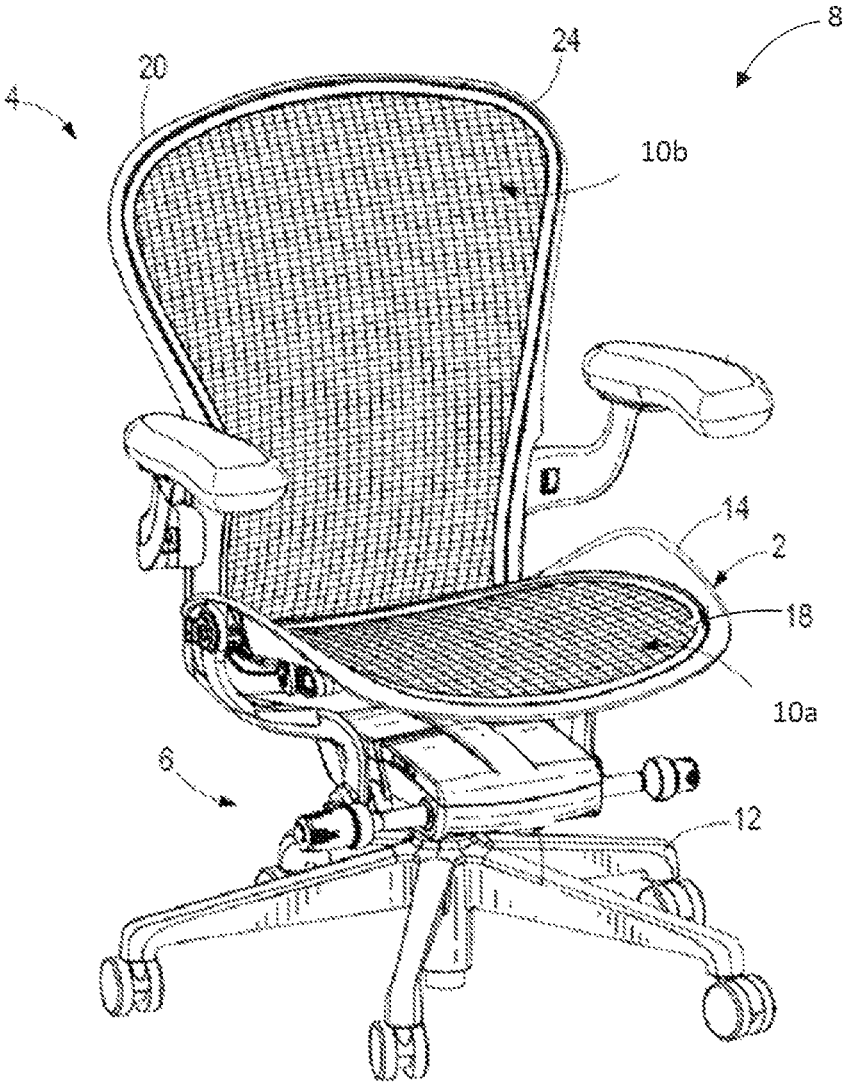
FIG. 1 is a chair with a suspension member according to one embodiment.

FIG. 1 shows an exemplary embodiment of a seating structure configured as a chair 8 that includes a seat 2, a backrest 4, and a base 6. The base 6 includes a tilt control housing, a support column coupled to and supporting the tilt control housing, and a base structure 12 coupled to and supporting the support column. The seat 2 includes a frame 14, a suspension member 10*a*, and a carrier 18. The carrier 18 retains the suspension member 10*a* and connects to the frame 14. The suspension member 10*a* extends across the frame 14 in order to support a user on the piece of furniture. Likewise, the backrest 4 includes a frame 20, a suspension member 10*b*, and a carrier 24. The carrier 24 retains the suspension member 10*b* and connects to the frame 20. The suspension member 10*b* extends across the frame 20 in order to support a user on the piece of furniture.

Figure 2:
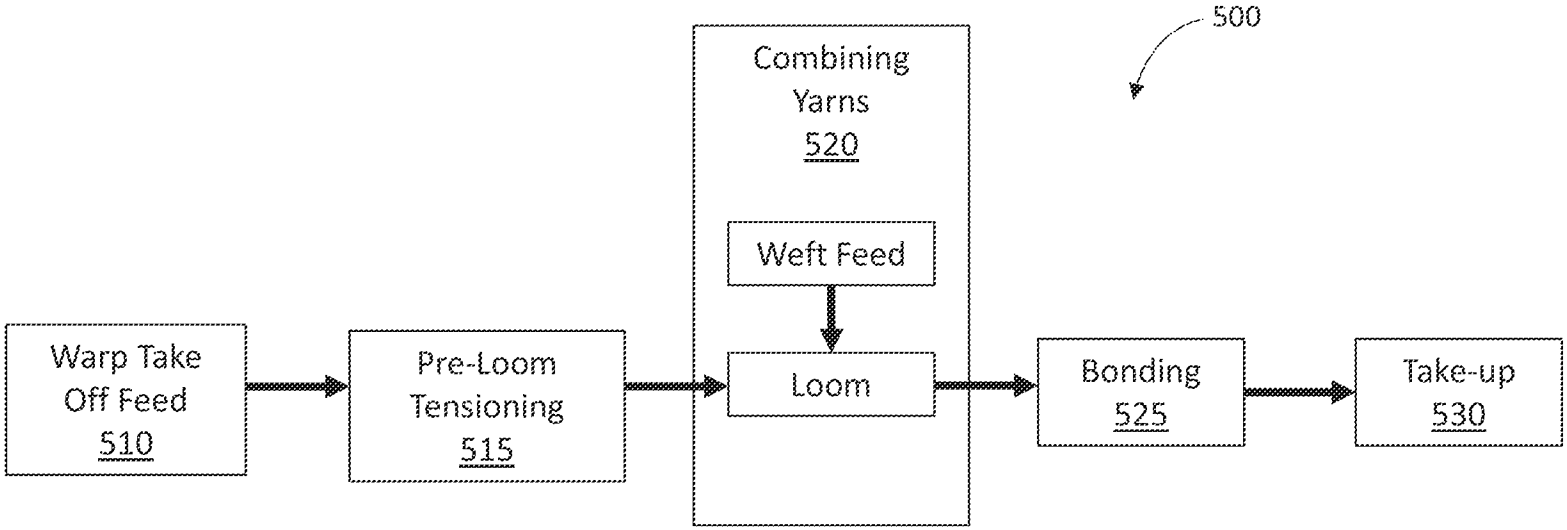
FIG. 2 is a flowchart depicting a method of manufacturing a suspension member according to one embodiment.
Figure 3:
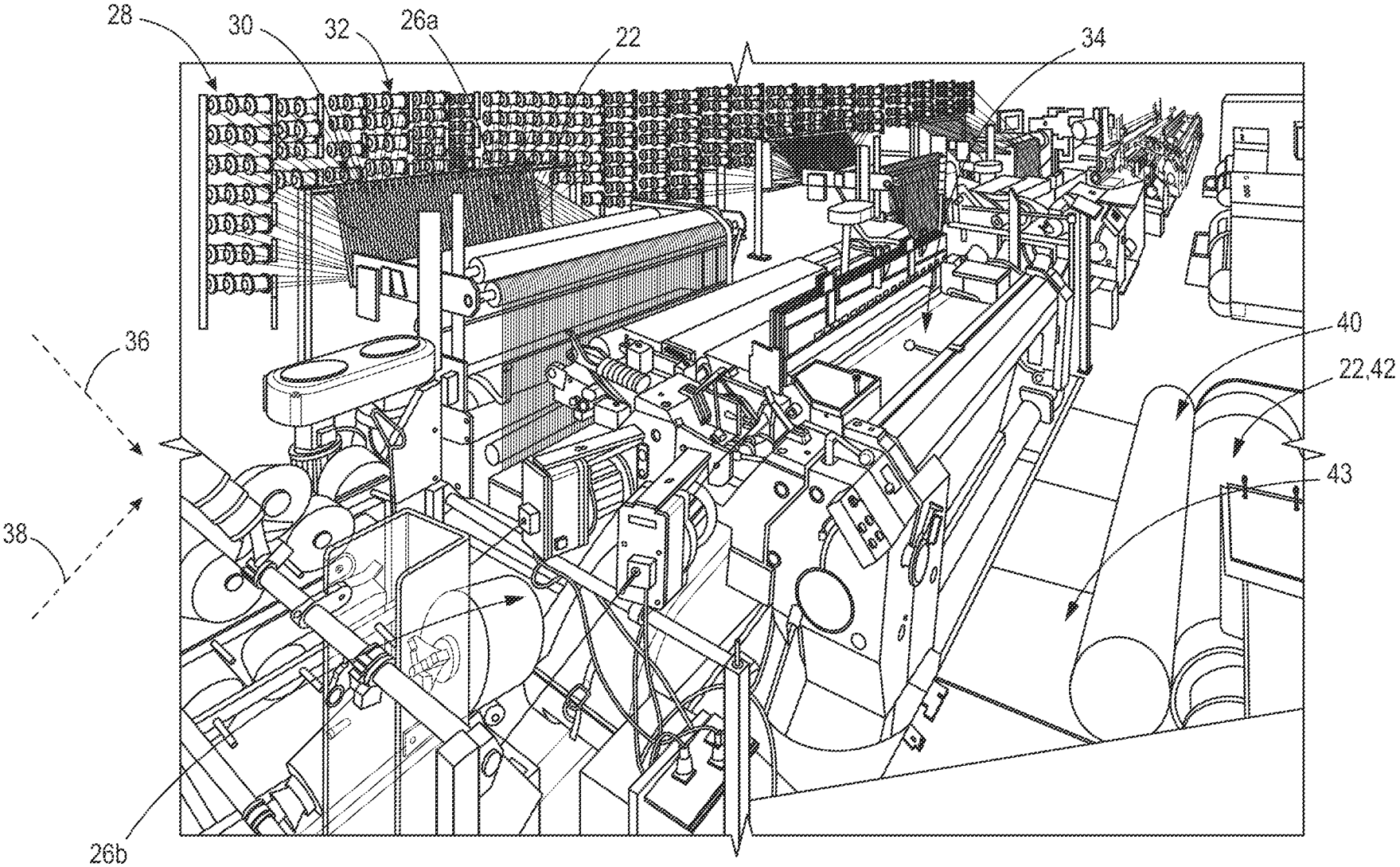
FIG. 3 is a system for manufacturing a suspension member according to one embodiment.

FIGS. 2-3 illustrate a system and method 500 of manufacturing a suspension member (identified generally as 10). The method 500 enables the suspension member 10 to be tensioned, and thereafter, fix the tension of the suspension member 10. Various methods of tensioning and fixing tension are provided herein. Additionally, the method 500 enables different zones 60 (FIGS. 11 and 12) of tension to be created in the suspension member 10 so that there is greater stiffness in some portions of the suspension member 10 than other portions. Although the method described herein includes specific steps, all of the steps need not be performed or may be performed in another order than presented. In some embodiments, the method 500 may include other steps or may not include all of the steps depicted. Additionally, the steps may be performed in different orders.

The method 500 includes the step of feeding a series of yarns 26 (e.g., warp yarns 26*a*) from a feeder 28 (step 510). The warp yarns 26*a* may be stored on a feeder 28, or creel, which includes a rack 30 supporting a plurality of spools 32 of yarns 26, as shown in FIG. 2. The spools 32 are rotatable on the rack 30 in order to feed the yarns 26 from the feeder 28. Feeding the warp yarns 26*a* from the spools 32 may be referred to as "warp take-off." In some embodiments, the warp yarns 26*a* are tensioned during warp take-off (step 510). The warp yarns 26*a* are fed in a first direction 36, or warp direction, from the spools 32 towards a loom 34, or weaving machine. The yarns 26 (and the suspension member 10) are moved from the feeder 28 through the system by a plurality of rollers (identified generally as 22)

After warp take-off (step 510) and prior to entering the loom 34, the warp yarns 26*a* may be tensioned (step 515). This step may be referred to as "pre-loom 34 tensioning." The warp yarns 26*a* may be tensioned during either one or both of warp take-off and pre-loom 34 tensioning using various different methods, as described below.

The method 500 further includes combining the first set of yarns 26 (e.g., warp yarns 26*a*) with a second set of yarns 26 (e.g., weft yarns 26*b*) (step 520). For example, combining the yarns 26 may include weaving weft yarns 26*b* through the warp yarns 26*a* (step 520). As the warp yarns 26*a* enter the loom 34, the warp yarns 26*a* will mix with a series of weft yarns 26*b* that are also fed into the loom 34. The warp yarns 26*a* are arranged to enter the loom 34 in a first direction 36, or warp direction, and the weft yarns 26*b* are fed into the loom 34 in a second direction 38, or weft direction, that is generally perpendicular to the first direction 36. The loom 34 is used to help weave the weft yarns 26*b* into the warp yarns 26*a*. One or both of the warp yarns 26*a* and the weft yarns 26*b* may be tensioned within the loom 34 during the weaving process (step 520). The warp yarns 26*a* and weft yarns 26*b* exit 54 the loom 34 after being woven together to form a suspension member 10.

As will be understood, the suspension member 10 may be formed using other fabric or textile making technics. For example, the suspension member 10 may be knit rather than woven together. In these instances, the yarns 26 are combined or knotted in the loom 34 or a similar device (step 520).

Once the warp yarns 26*a* and weft yarns 26*b* are woven together to form the suspension member 10, the tension of the suspension member 10 may be fixed using a bonding process (step 525). The bonding process occurs in a bonding unit 40, where the yarns 26 are at least partially bonded or fused together to reduce the amount of movement between the yarns 26. Although the warp yarns 26*a* and/or weft yarns 26*b* may be tensioned during any of the previous steps, they may be able to slip or shift depending on the degree of tension, the material used, the type or size of the frames that will be used to hold the yarns 26 in place, etc. By bonding the yarns 26 together, the amount of slippage that may occur will be reduced. The bonding process may include heating some or all of the yarns 26 in order to fuse them together and fix the tension of the suspension member 10. By heating the suspension member 10, some of the yarns 26 will at least partially melt and stick together, thereby fusing those yarns 26 together. This in and of itself may be considered a type of tensioning process.

After the bonding process (step 525) is complete, the suspension member 10 is wound up on a large take-up roller 22, 42 during the "take-up" process (step 530). The take up process (step 530) generally includes a packaging up or rolling up of the tensioned suspension member 10. The take up process may also include aligning the suspension member 10.

Bonding Process—Controlling Tension of a Suspension Member

The bonding process (step 525) may be used to control tension of the suspension member 10 in a variety of different ways. For example, the bonding process (step 525) may control the tension of the suspension member 10 by: 1) creating tension in the suspension member 10; 2) fixing tension of the suspension member 10 where the tension is created via other means; and 3) creating zones 60 of tension.

More specifically, in some embodiments, the bonding process (step 525) may be used to create tension in the suspension member 10 by bonding the yarns 26 together, which restricts the movement of the yarns 26 relative to each other. This, in turn, tensions the suspension member 10 by reducing the flexibility of the suspension member 10.

Additionally, in some embodiments the bonding process (step 525) is used to fix tension in the suspension member 10, where the suspension is created via a different means than the bonding unit 40. For example, the suspension member 10 may be tensioned prior to arriving at the bonding unit 40. The bonding unit 40 can then be used to fix the tension created in the suspension member 10 by heating the suspension member 10 to maintain the tension.

Furthermore, the bonding process (step 525) may be used to create different zones 60 of tension. In particular, the zones 60 of tension may be created directly by the bonding unit 40 by applying different amounts of heat to different portions of the suspension member 10. For example, the heat may only be applied to certain areas of the suspension member 10 in order to fix a tension in the heated portion and allow the other portions of the suspension member 10 to remain unfixed. The zones 60 of tension may also be created indirectly by the bonding unit 40. For example, when the suspension member 10 is tensioned into different zones 60 by other tensioning means, the bonding unit 40 may fix the zones 60 of tension by heating the suspension member 10.

The Bonding Process—Bonding Unit

The bonding process (step 525) occurs in the bonding unit 40 where heat is applied to the suspension member 10 in order to fix the tension of at least part of the suspension member 10. In some embodiments, infrared light, convection or contact heating can be used to apply heat to the suspension member 10. In other embodiments, the bonding process may include applying a UV light to the suspension member 10 to react with UV curable compounds in or on the suspension member 10. The bonding process (step 525) is also one form of controlling or creating tension in the suspension member 10. The bonding process (step 525) may occur in a bonding unit 40 where heat is applied to the suspension member 10.

Figure 4:
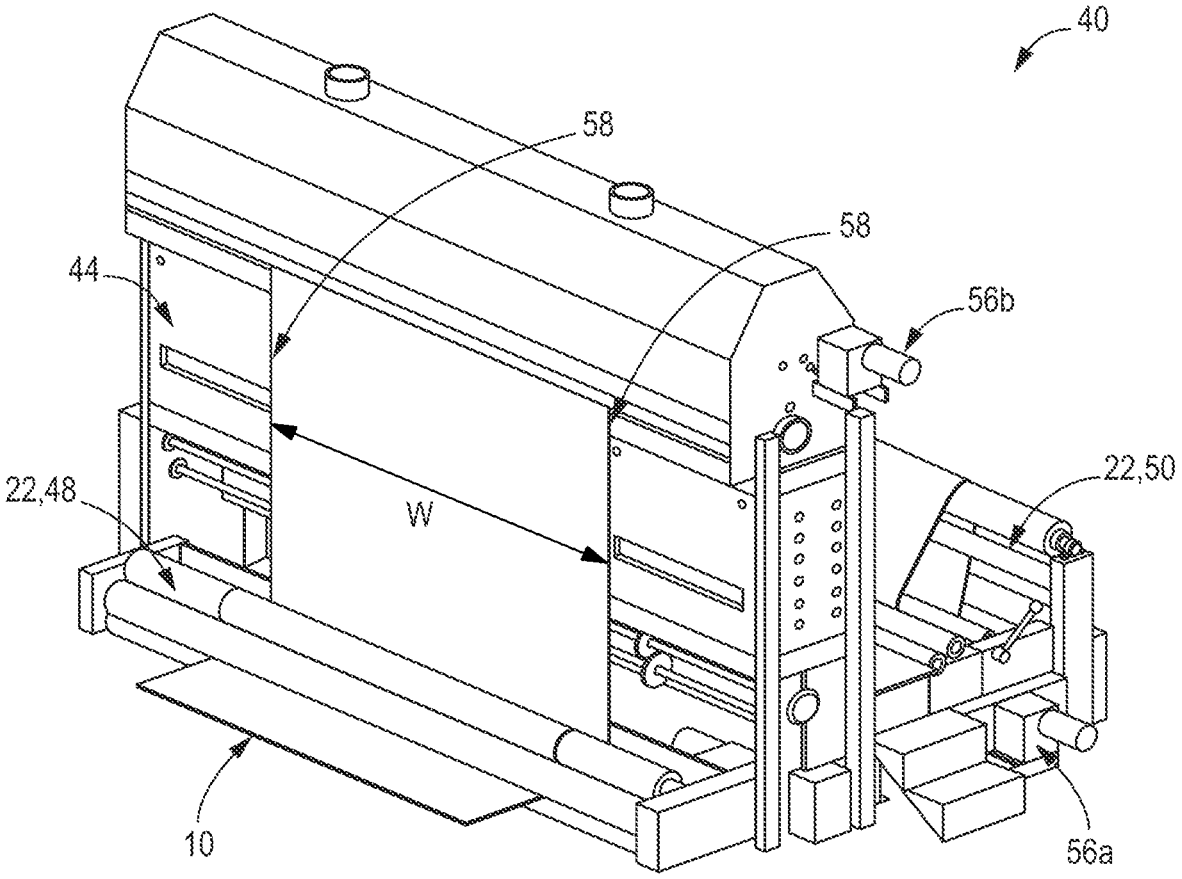
FIG. 4 is a heating unit according to one embodiment.
Figure 5B:
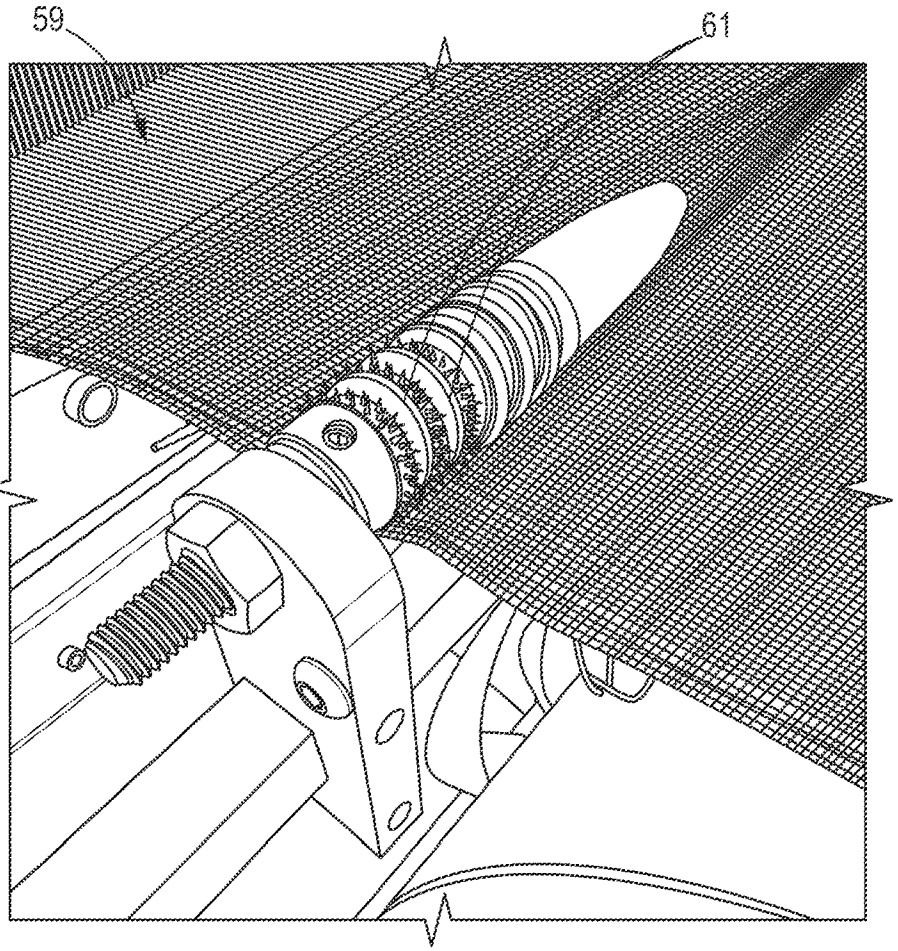
FIG. 5B is a detailed view of a temple that may be used with the heating unit of FIG. 4.
Figure 5A:
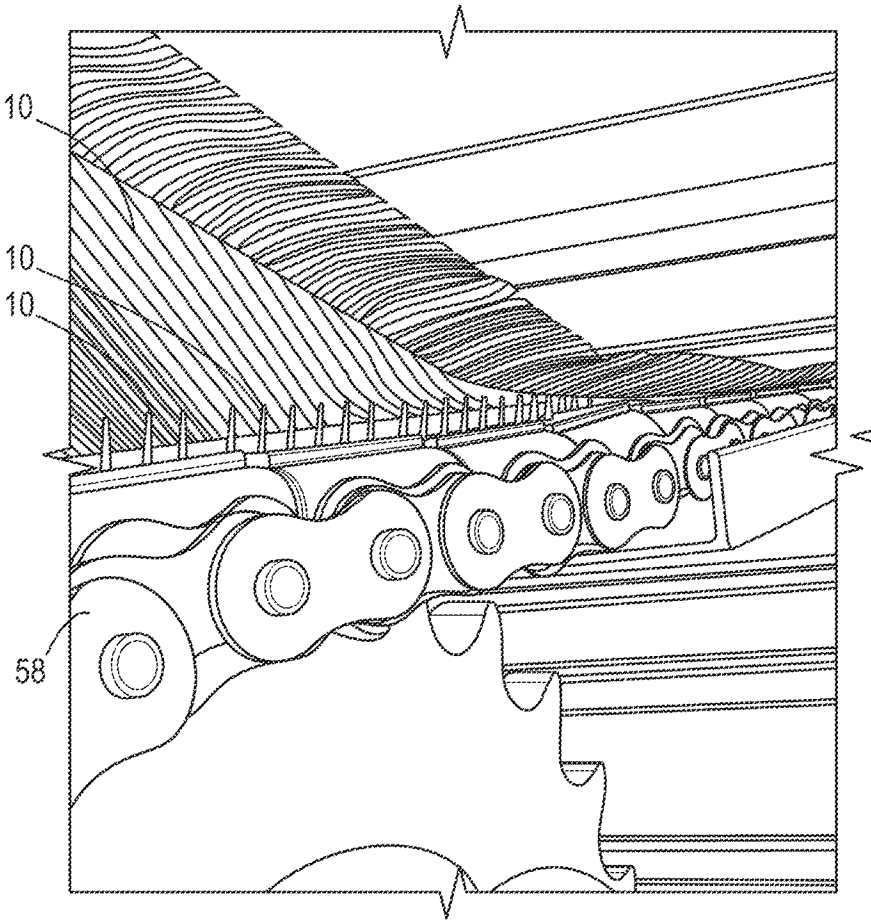
FIG. 5A is a detailed view of a tenter chain that may be used with the heating unit of FIG. 4.
Figure 6:
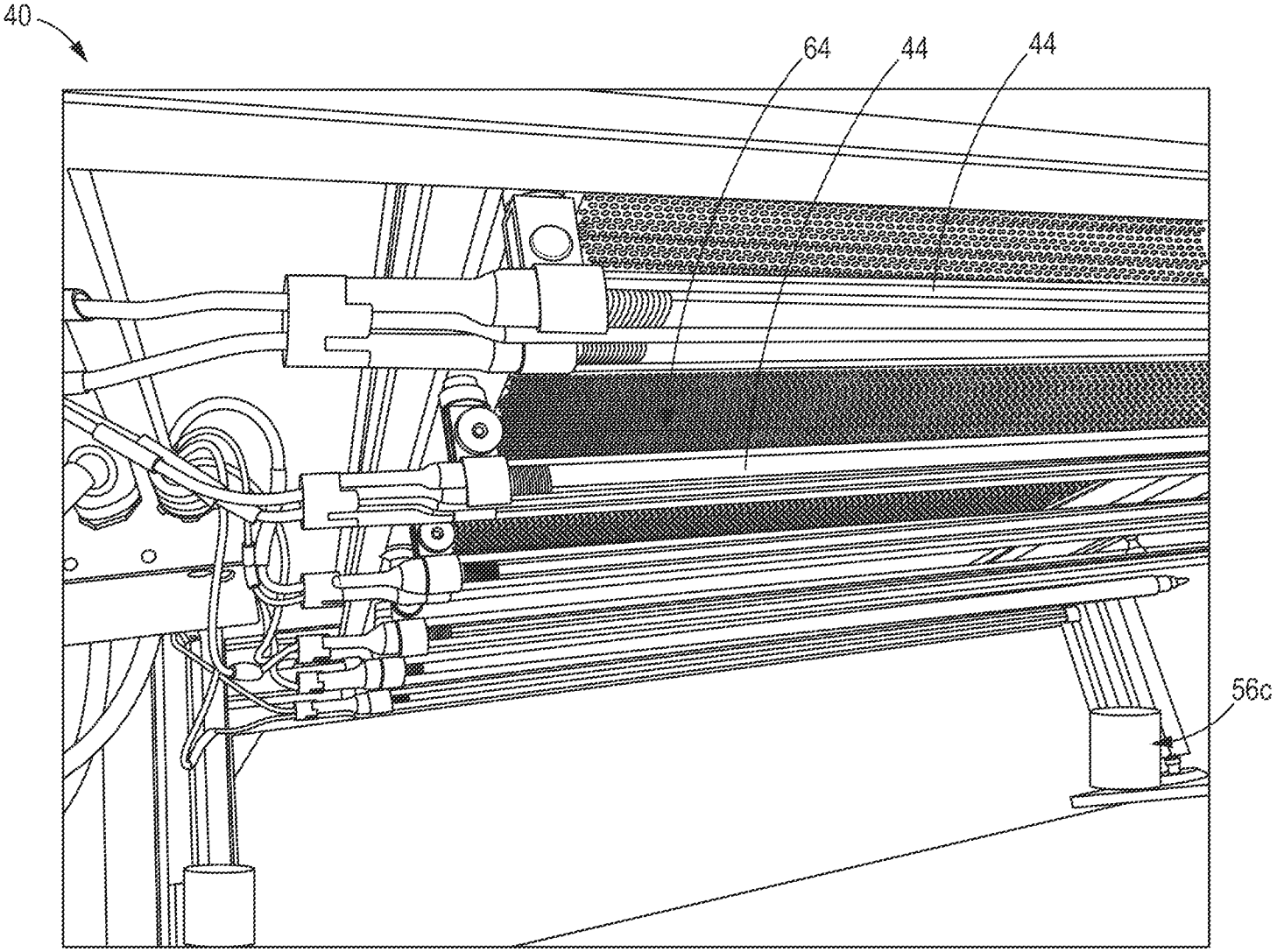
FIG. 6 is a detailed view of a portion of the heating unit of FIG. 4.

FIGS. 4-6 illustrate one exemplary embodiment of a bonding unit 40. The bonding unit 40 includes one or more heating element 44 configured to heat at least a portion of the suspension member 10. The bonding unit 40 also includes feed rollers 22, 48 and take-up rollers 22, 50 to help move the suspension member 10 through the bonding unit 40. The feed rollers 22, 48 are positioned upstream of the heating elements 44 proximate an entrance 52 of the bonding unit 40. The take-up rollers 22, 50 are positioned downstream of the heating elements 44 proximate an exit 54 of bonding unit 40. The feed rollers 22, 48 and/or the take-up rollers 22, 50 may also be used to tension the suspension member 10. In some embodiments, the feed rollers 22, 48 may be the same rollers 22 as those used to move the suspension member 10 through the loom 34 (step 520). Similarly, in some embodiments, the take-up rollers 22, 50 may be the same rollers 22 used in the take-up process (step 530).

The illustrated bonding unit 40 also includes one or more motors 56 to help move various components of the bonding unit 40. For example, one or more motors 56 may be used to drive rollers 22 that move the suspension member 10 through the bonding unit 40. For example, the bonding unit 40 may include a take-up drive motor 56*a* that drives rotation of the take-up rollers 22, 50. The illustrated bonding unit 40 further includes tenter chains 58 on each side of the suspension member 10 to help move the suspension member 10 through the bonding unit 40 while also maintaining the alignment of the suspension member 10. As shown in FIG. 5A, the tenter chains 58 include pins 62, 72 along the length of the chain 58 engageable with the suspension member 10 to grip the suspension member 10. The tenter chains 58 may be driven by a chain drive motor 56*b* to drive the suspension member 10 through the bonding unit 40. In some embodiments, the tenter chains 58 are parallel to each other. In other embodiments, the distance between the tenter chains 58 and width W of the suspension member 10 such that the tenter chairs 58 are closer together in a first position and further apart in a second position. In other embodiments, the tenter chains 58 may be closer together in a first position, further apart in a second position and then closer together in a third position. In some embodiments, the tenter chains 58 are driven at the same speed. In other embodiments, the tenter chains 58 are driven at different speeds to create a differential stiffness in the suspension material 10. Similarly, as shown in FIG. 5B, tension may also be created by using a temple 59. The temple 59 includes a plurality of spikes 61 that may grip the suspension member 10 and help move the suspension member 10 through the bonding unit 40.

Tension may also be created by varying the pitch of thread of the suspension member 10 with the spikes 61, by varying the size and spacing of the spikes 61, by varying the length of the temple 59, and by varying pressure from the temple on the suspension member 10. In some embodiments, a series of temples 59 may be used along the length of the suspension member 10 to create tension as the fabric moves through the system. Tenter chains 58 and temples 59 may be used anywhere on the suspension member 10 to create tension.

As the suspension member 10 is moved through the bonding unit 40, heat may be selectively applied to the suspension member 10 to fix the tension of the suspension member 10. The heating element 44 can be different shapes and sizes in order to accomplish various heating techniques. In some embodiments, the bonding unit 40 may include a plurality of heating elements 44. The plurality of heating elements 44 may all be the same size and shape or may be a variety of sizes and shapes.

FIG. 6 illustrates an exemplary embodiment of heating elements 44 for use in the bonding unit 40. In this embodiment, the heating elements 44 are similar size and shape as one another. Additionally, the heating elements 44 are in rows and are spaced apart equal distance from one another. However, in other embodiments, the heating elements 44 can have different arrangements and can be a mix of different sizes, shapes, and orientations.

The Bonding Process—Application of Heat

The bonding unit 40 may apply heat to the suspension member 10 in a variety of ways in order to create tension in the suspension member 10, fix tension in the suspension member 10, or create zones 60 of tension in the suspension member 10.

For example, the heating element 44 may apply heat to the suspension member 10 in a continuous manner or in a discontinuous manner to selectively bond the yarns 26 of the suspension member 10 to one another. For example, the one or more heating elements 44 may be selectively turned on or off as the suspension member 10 moves through the bonding unit 40. As another example, the distance between the heating element 44 and the suspension member 10 may be adjusted to apply more or less heat to the suspension member 10. In some embodiments, some of the plurality of heating elements 44 are positioned closer to the suspension member 10 than others in order to apply a greater amount of heat. In some embodiments, the heating element 44 may be moved (e.g., by a motor 56*c*) closer to or farther away from the suspension member 10 as the suspension member 10 moves though the bonding unit 40 in order to adjust the amount of heat being applied to the suspension member 10. Additionally, the heaters themselves may be controlled to adjust the intensity of the heat being applied to the suspension member 10. For example, the temperature of the heat element may be adjusted.

Figure 29A:
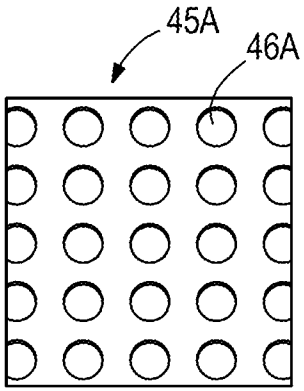
FIG. 29A illustrates a screen that may be used with the heating unit of FIG. 4 according to one embodiment.
Figure 29B:
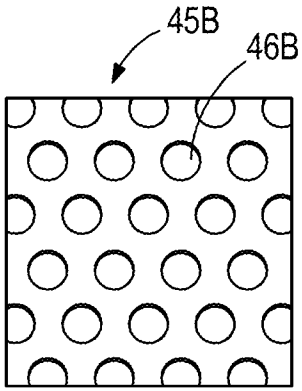
FIG. 29B illustrates a screen that may be used with the heating unit of FIG. 4 according to one embodiment.
Figure 29C:
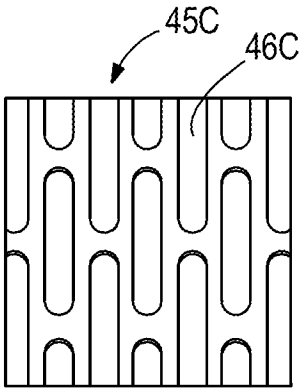
FIG. 29C illustrates a screen that may be used with the heating unit of FIG. 4 according to one embodiment.
Figure 29D:
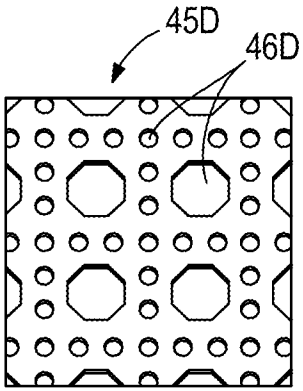
FIG. 29D illustrates a screen that may be used with the heating unit of FIG. 4 according to one embodiment.
Figure 29E:
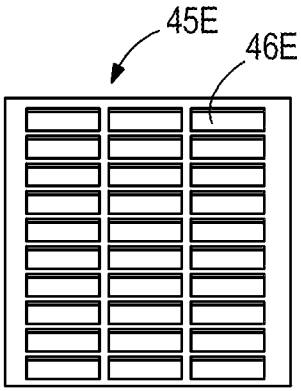
FIG. 29E illustrates a screen that may be used with the heating unit of FIG. 4 according to one embodiment.
Figure 29F:
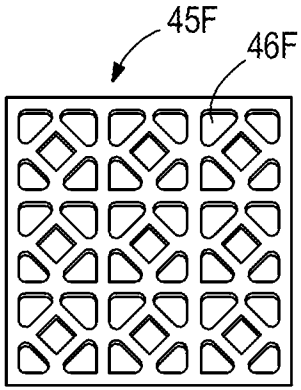
FIG. 29F illustrates a screen that may be used with the heating unit of FIG. 4 according to one embodiment.
Figure 29G:
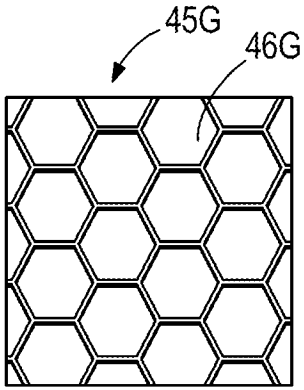
FIG. 29G illustrates a screen that may be used with the heating unit of FIG. 4 according to one embodiment.
Figure 29H:
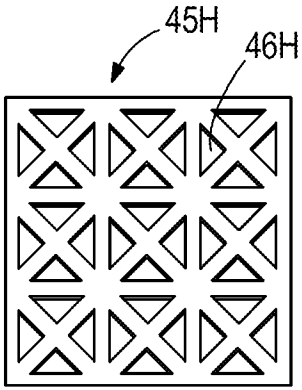
FIG. 29H illustrates a screen that may be used with the heating unit of FIG. 4 according to one embodiment.
Figure 29I:
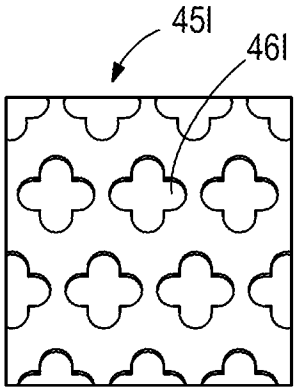
FIG. 29I illustrates a screen that may be used with the heating unit of FIG. 4 according to one embodiment.
Figure 29J:
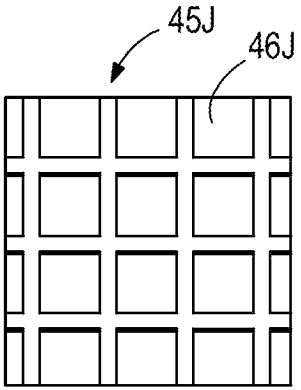
FIG. 29J illustrates a screen that may be used with the heating unit of FIG. 4 according to one embodiment.

In addition, in some embodiments, screens 45A-J may be used to block the heat from reaching portions of the suspension member 10 (see FIGS. 29A-29J). The screens 45A-J may be formed of any material capable of blocking at least a portion of the heat expelled from the heating elements 44 from reaching the suspension member 10. In one embodiment, the screen 45A-J may have holes that allow only a desired amount of heat to pass through. For example, the screen 45A-J may have larger or smaller holes to allow a greater or lesser amount of heat to pass through. Likewise, the screen 45A-J may have a greater number of densely packed holes to allow more heat to pass through, or may have a fewer number of holes that are more spaced apart in order to reduce the amount of heat to pass through. With reference to FIG. 29A, the holes 46A can be round in shape and be aligned in a straight pattern. With reference to FIG. 29B, the holes 46B can be round in shape and be arranged in a staggered pattern. With reference to FIG. 29C, the holes 46C can be slotted and arranged in a staggered pattern. With reference to FIG. 29D, some of the holes 46D can be round in shape and the other holes 46D can be octagonal. The round holes 46D can be arranged in squares around the octagonal holes 46D. With reference to FIG. 29E, the holes 46E can be rectangular in shape. With reference to FIG. 29F, the holes 46F can be arranged in a Marietta pattern. With reference to FIG. 29G, the holes 46G can form a honeycomb structure and can be hexagonal in shape. With reference to FIG. 29H, the holes 46H can be triangular in shape and can be arranged in a Grecian pattern. With reference to FIG. 29I, the holes 46I can have a clover shape. With reference to FIG. 29J, the holes 46J can be square.

The screens 45A-J may also be different sizes and shapes. The screens 45A-J may also be selectively applied at desired times to affect the bonding of the yarns 26. For example, the screens 45A-J may be manually moved relative to the suspension member 10 or may be coupled to an actuator (e.g., a motor, etc.) that automatically moves the screens 45A-J at desired or programmed times. In some embodiments, the screens 45A-J may be used to create patterns (e.g., aesthetic patterns) on the suspension member 10. The patterns are formed by the varied appearance of areas with bonding yarns 26 verses areas with non-bonded yarns 26. For example, a circular screen may be used to create a circular pattern or circular area with non-bonded yarns 26. The screens 45A-J may also include optical filters which selectively transmit light of different wavelengths. The optical filters may filter out UV light or IR light.

Furthermore, in some embodiments, the amount of heat being applied to the suspension member 10 may be varied or controlled by a controller. The controller may control any combination of the following: the heating elements 44, the rollers 22 that control the speed at which the suspension member travels through the bonding unit 40, and the screens 45A-J that block at least a portion of the heat transmitted towards the suspension member 10. In some embodiments, the bonding unit 40 may be programed to control the heating element 44 and/or the screens 45A-J. For example, the bonding unit 40 may be programed to control any of the following: 1) the intensity of the heat emitted from a heating element 44; 2) power to one or more heating element 44 to turn the heating element 44 on or off, 3) the distance between the heating element 44 and the suspension member 10; and 4) the use of screens 45A-J between the heating element 44 and the suspension member 10. This is a non-exhaustive list of items that may be programed. As will be described in greater detail below, heat may be selectively applied to the suspension member 10 in order to create different zones 60 of tension and stiffness on the suspension member 10.

For example, in some embodiments, the heating element 44 may extend across the entire width W of the suspension member 10, while in other embodiments, the heating element 44 may only extend across a portion of the width W of the suspension member 10. For the purpose of this application the term length is used to refer to the suspension member 10 in the direction of travel (i.e., in the warp direction), while the term width is used to refer to the suspension member 10 in the direction of the weft yarns 26*b*.

In some embodiments, the heating element 44 is applied to the suspension member 10 in a continuous manner. For example, in the case where the heating element 44 extends across the entire width W of the suspension member 10, both the entire width W and length of the suspension member 10 is heated as the suspension member 10 moves across the heating element 44. Alternatively, if only a portion of the width W of the suspension member 10 is heated, then the suspension member 10 will result in a lengthwise strip of bonded yarns 26 and a lengthwise strip of non-bonded yarns 26 as the suspension member 10 travels across the heating element 44.

In yet another embodiment, the heating element 44 may apply heat to the suspension member 10 in a discontinuous manner. For example, the heating element 44 may "stamp" the suspension member 10 and apply heat to the suspension member 10 by temporarily making contact with the suspension member 10. For example, the heating element 44 may have various shapes such as a circle or rectangle that may be stamped onto the suspension member 10. In this embodiment, the suspension member 10 may temporarily stop moving across the heating element 44 long enough to allow the heating element 44 to stamp the suspension member 10. The suspension member 10 may then continue moving across the heating element 44 once the heating element 44 is retracted away from the suspension member 10.

Similarly, the heating element 44 may be slowly moved towards and away from the suspension member 10 in order to control the amount of heat applied to the suspension member 10, and thus, the degree of bonding that occurs between the yarns 26. For example, the heating element 44 may apply more heat to the suspension member 10 as the heating element 44 moves towards the suspension member 10 and apply less heat to the suspension member 10 as the heating element 44 moves away from the suspension member 10. By repeatedly moving the heating element 44 towards and away from the suspension member 10, the suspension member 10 will result in widthwise strips of bonded yarns 26 and strips of non-bonded yarns 26.

Bonding Process—Materials and Arrangement of Yarns

Yarns 26 of various different materials and different properties may be used in order to accomplish the bonding of the yarns 26, and thereby, fix the tension of the suspension member 10. FIGS. 7-10 illustrate some of the different types of yarns 26 that may be used and some of the different arrangements that may be used. However, FIGS. 7-10 illustrate only a small subset of the different arrangements of yarns 26 that may be used to enable the bonding process (step 520) to be successful.

Some of the yarns 26 may be monofilaments yarns 72 and some of the yarns 26 may be multifilaments yarns 74. The monofilament yarns 26, 72 may be composed of a single material, as shown in FIG. 8B, whereas the multifilament yarns 26, 74 may be composed of multiple materials, as shown in FIG. 9B. In some embodiments, the monofilament yarns 72 may be bicomponent fibers. In some embodiments, the monofilament yarns 72 may have more than two components. In some embodiments, the multifilament yarns 74 may be a bicomponent fibers. In some embodiments, the multifilament yarns may have more than two components. In some embodiments, the multifilament yarns 74 may have a multifilament outer sheath and a multifilament core. In some embodiments, the multifilament yarns 74 may have a multifilament outer sheath and a monofilament core. In some embodiments, the multifilament yarns may have a round cross-section, a trilobal cross-section, or a pentagonal cross-section. In some embodiments, the multifilament yarns may have a hollow pie wedge configuration, a tipped trilobal configuration, a bowtie configuration, a side by side bowtie configuration, a segmented ribbon configuration, an Islands-in-the-Sea configuration, a sixteen segment pie configuration, a stripped configuration, a side by side configuration, or a core-sheath configuration. The multifilament yarns 26, 74 often include multiple materials having different characteristics. For example, referring to FIGS. 9B and 10B, a multifilament yarn 26, 74 may include a core 76 composed of a first material and a sheath 78 composed of a second material.

The warp yarns 26*a* and the weft yarns 26*b* may be in arranged using a various combinations of monofilament yarns 72, multifilament yarns 74, and/or biocomponent fibers. In some embodiments, the warp yarns 26*a* are multifilament yarns 26, 74 and the weft yarns 26*b* are monofilament yarns 26, 72. In other embodiments, the warp yarns are multifilament yarns and monofilament yarns and the weft yarns are monofilament yarns. In other embodiments, the warp yarns are multifilament yarns and the weft yarns are multifilament yarns and monofilament yarns. In other embodiments, one or both the warp yarns 26*a* or the weft yarns 26*b* may include a mixture of monofilament yarns 72, multifilament yarns 74, and/or biocomponent fibers.

Figure 7:
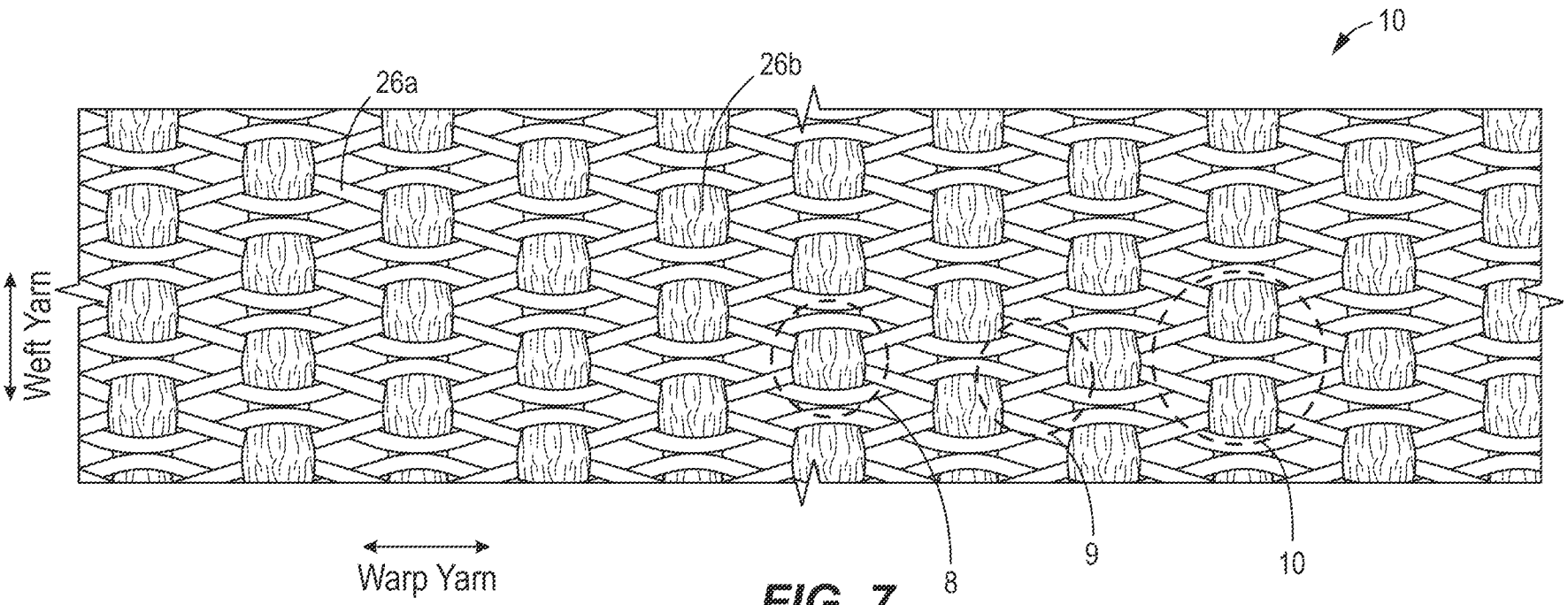
FIG. 7 is a suspension member according to one embodiment.
Figure 8A:
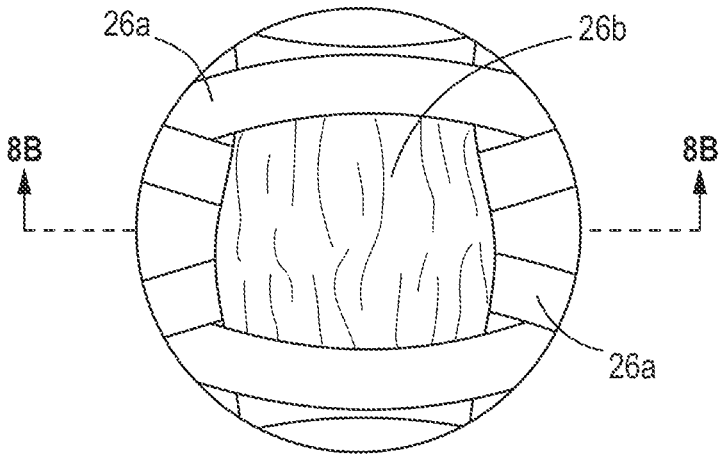
FIG. 8A is a detailed view of a portion of the suspension member of FIG. 7.
Figure 8B:
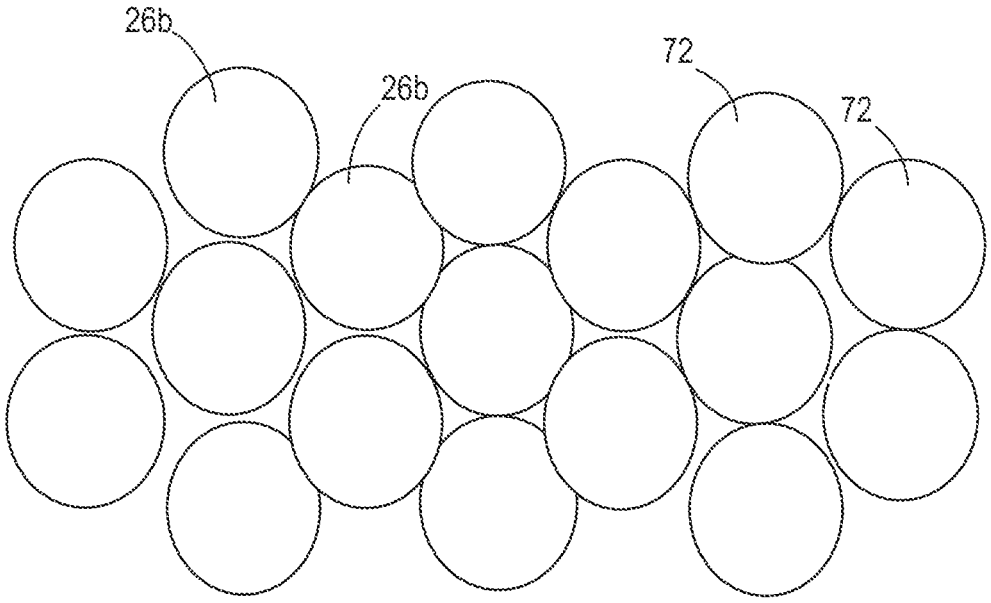
FIG. 8B is a cross-sectional view taken along line 8B-8B of FIG. 8A.
Figure 9A:
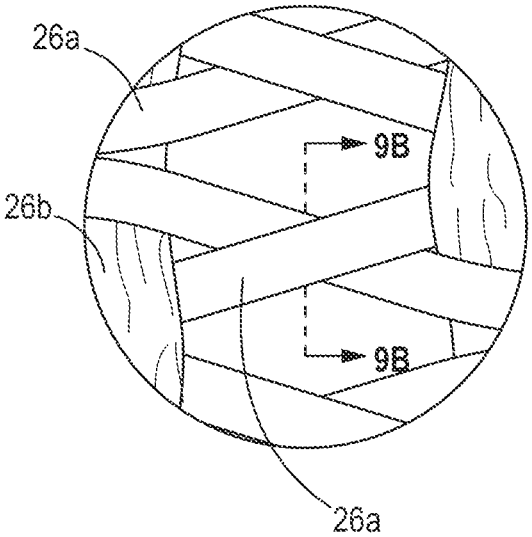
FIG. 9A is a detailed view of a portion of the suspension member of FIG. 7.
Figure 9B:
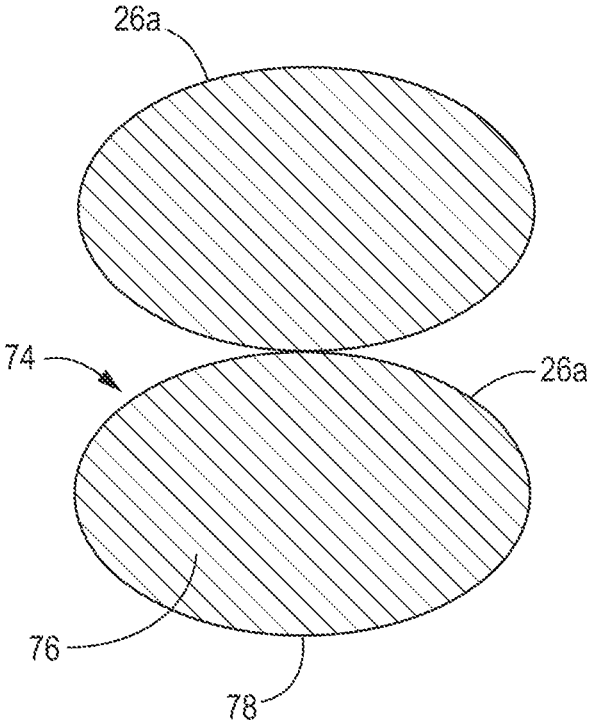
FIG. 9B is a cross-sectional view taken along line 9B-9B of FIG. 9A.

With continued reference to FIGS. 7-10, the warp yarns 26*a* and weft yarns 26*b* may be grouped together in different arrangements. For example, as shown in FIGS. 7 and 8, the weft yarns 26*b* may include a plurality of monofilament yarns 26, 72 that are bunched together and weaved through the warp yarns 26*a* in a bunch (i.e., where the bunch all follows the same weave path through the warp yarns 26*a*). As shown in FIGS. 7 and 9, the warp yarns 26*a* may each be separated into single multifilament yarns 26, 74 that follow individual weave paths. Alternatively, both the warp yarns 26*a* and the weft yarns 26*b* may be grouped into bunches and then weaved together. In some embodiments, one or both of the warp yarns 26*a* and the weft yarns 26*b* include bunches of yarns 26 having a combination of monofilament yarns 26, 72 and multifilament yarns 26, 74.

Additionally, the different yarns 26 used may have different melting points. This helps to control which yarns 26 melt and the degree of melting that occurs. For example, as shown in FIG. 9B, the multifilament yarns 26, 74 may include a core 76 having a melting point above a first temperature and a sheath 78 having a melting point below the first temperature. Thus, when the multifilament yarns 26, 74 are heated to the first temperature, the sheath 78 would at least partially melt while the core 76 would remain intact. When the sheath 78 of the warp yarns 26*a* melt, the warp yarns 26*a* bond together and limit movement of the yarns 26 relative to one another. Alternatively, in some embodiments, the warp yarns 26*a* are monofilament yarns 26, 72 that melt into each other, allowing the warp yarns 26*a* to bond to other warp yarns 26*a*. This melting and bonding helps fix the tension of the suspension member 10 at the location of the melting.

Figure 10B:
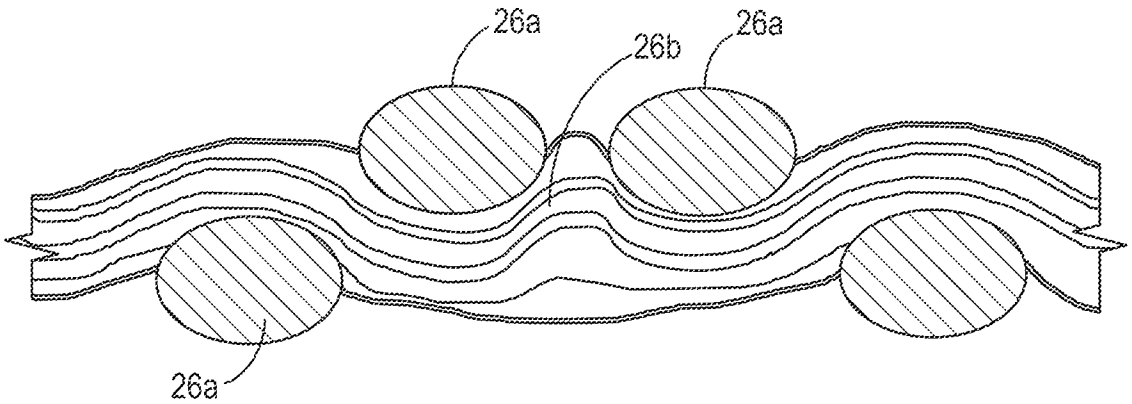
FIG. 10B is a cross-sectional view taken along line 10B-10B of FIG. 10A.
Figure 10A:
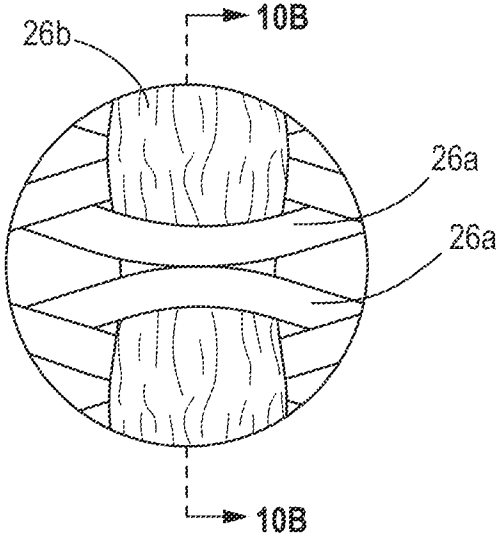
FIG. 10A is a detailed view of a portion of the suspension member of FIG. 7.

In some embodiments, warp yarns 26*a* may bond to other warp warns, or the weft yarns 26*b*, or both. For example, as shown in FIG. 10, in some embodiments, the weft yarns 26*b* may have a melting point above a second temperature and the warp yarns 26*a* may have a melting point below the second temperature. Thus, when the suspension member 10 is heated, the warp yarns 26*a* begin to melt and bond to the weft yarns 26*b*. In some embodiments, the warp yarns 26*a* are monofilament yarns 26, 74 that may melt and bond to the weft yarns 26*b*. In other embodiments, the warp yarns 26*a* are multifilament yarns 26, 76 where only the sheath 78 78 of each warp yarns 26 melts and bonds to the weft yarn 26. Likewise, the weft yarns 26*b* may be composed of different combinations of monofilament yarns 26, 74 and multifilament yarns 26, 76 that are capable of bonding to either other weft yarns 26*b* or other warp yarns 26*a*.

The types of yarns 26, number of yarns 26, and arrangement of yarns 26 may affect the degree to which the tension of the suspension member 10 is fixed. Furthermore, the suspension member 10 may be tensioned zonally such that different areas (or zones 60) of the suspension member 10 have different tensions or stiffnesses.

Zones of Tension

Figure 11:
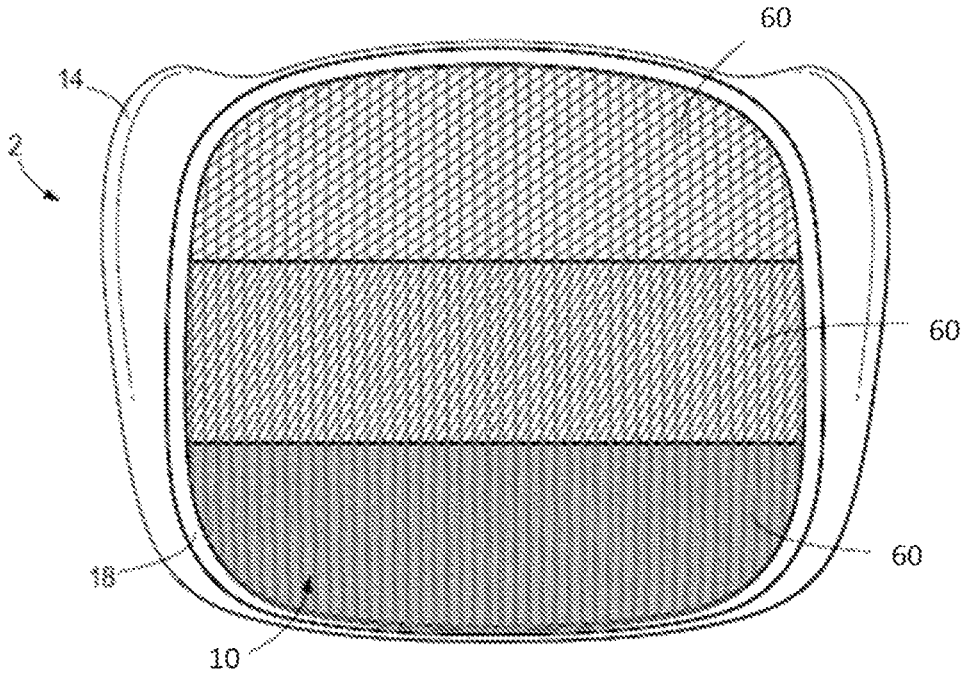
FIG. 11 is a seat with a suspension member having zones according to one embodiment.
Figure 12:
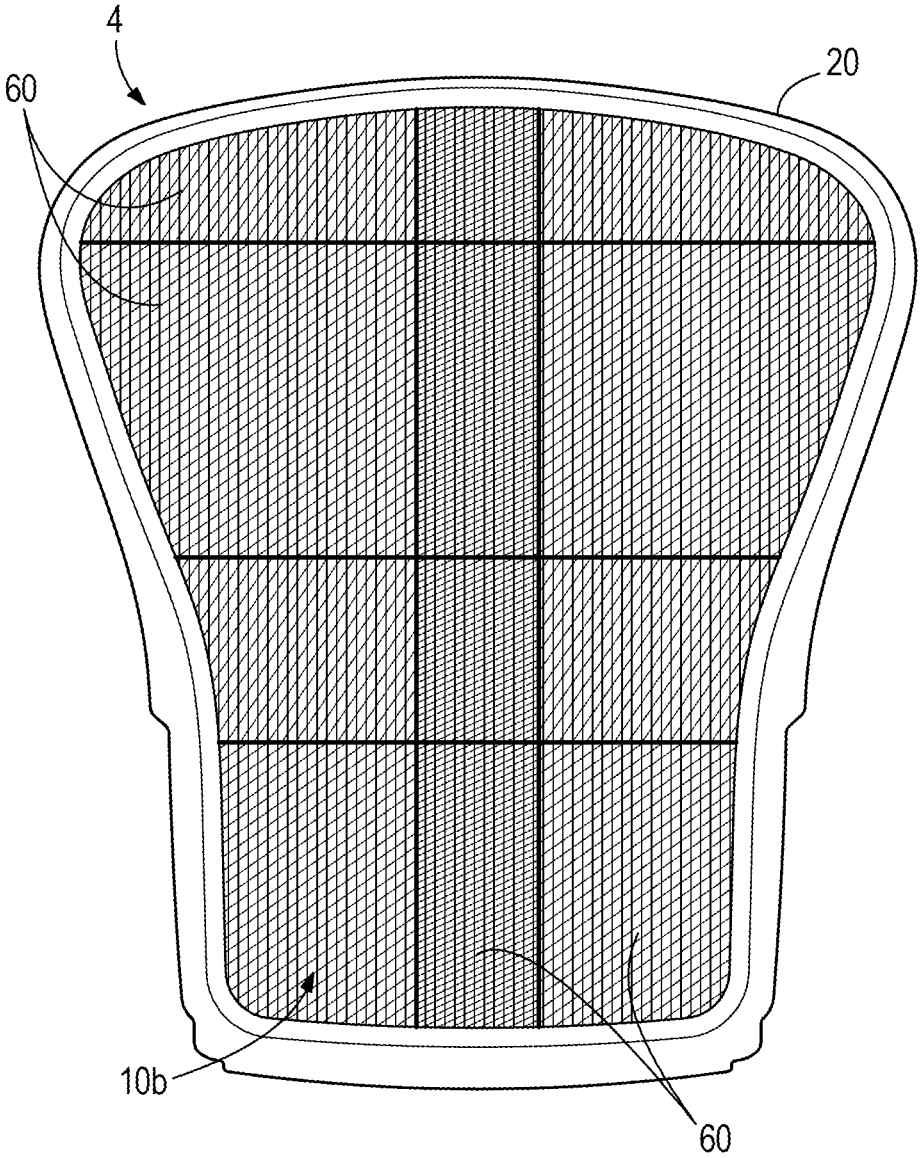
FIG. 12 is a backrest with a suspension member having zones according to one embodiment.
Figure 13:
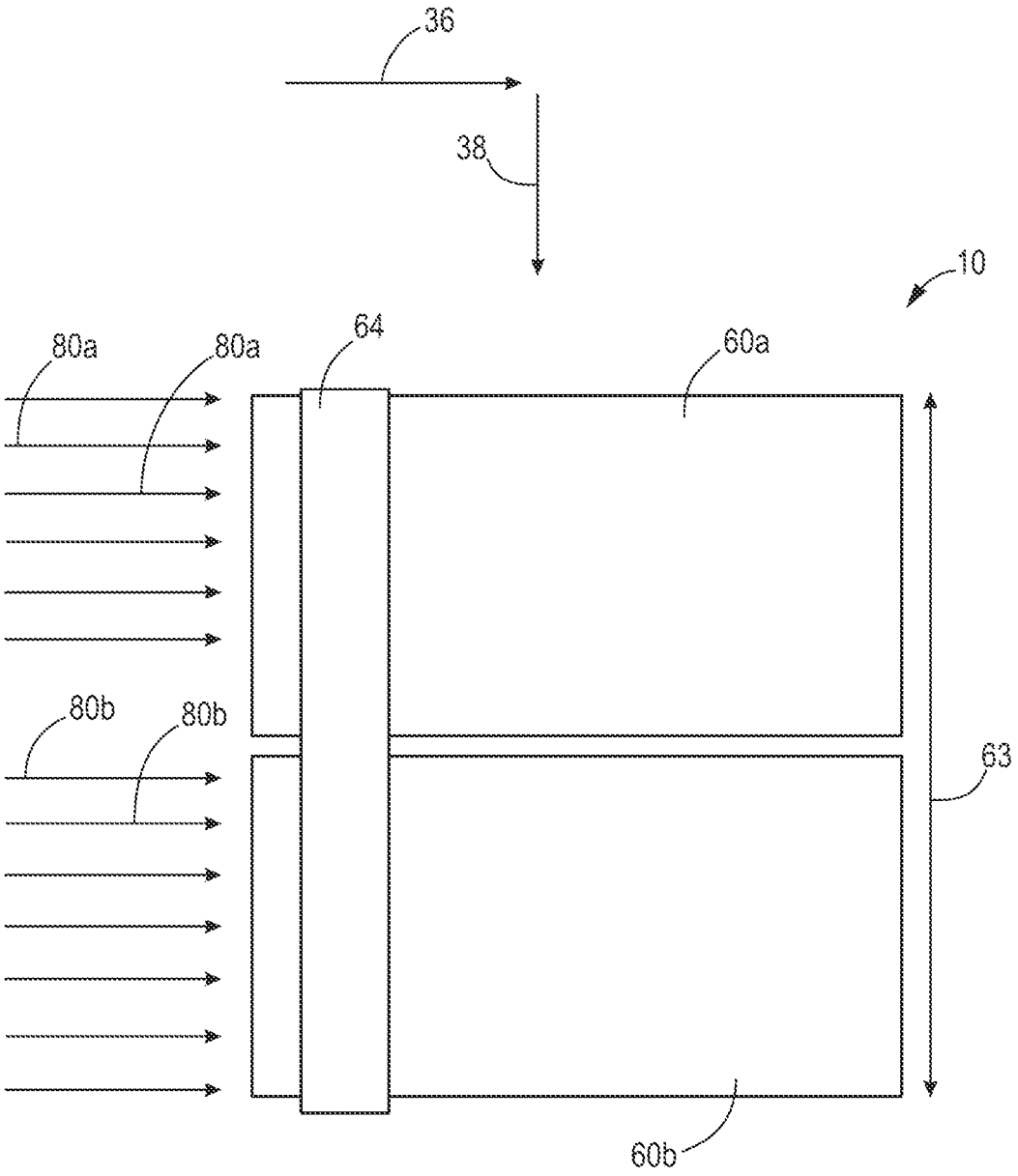
FIG. 13 is a schematic illustration of one embodiment of creating different zones of tension in a suspension member.

As shown in FIGS. 11-13, in some embodiments, the suspension member 10 can include different zones 60 (referenced generally as 60), which each have different characteristics. For example, in one embodiment, the zones 60 are designated to have different levels of stiffness to increase the comfort and/or support of the seating structure for a user. The zones 60 can then be aligned within the carrier 18, 24 so that the zones 60 having greater stiffness are positioned in locations where more support is desired, and the zones 60 having greater flexibility are positioned in locations were greater comfort is desired. For example, the zones 60 may correspond to different anatomical zones 60 of a user's back. Accordingly, a different tension and stiffness may be desired in each zone 60 to provide comfort and support to the corresponding anatomical zone 60 of the user.

In another embodiment, the zones 60 can have a different appearance, such as different patterns or tones. As described above, the patterns and tones can be created during the bonding process, for example, by heating certain areas of the suspension member 10 to affect the appearance of the suspension member 10 in those areas. The zones 60 can be arranged within the carrier 18, 24 to create a certain aesthetic appearance. The zones 60 can have different sizes and shapes. For example, although the zones 60 illustrated in FIGS. 9-10 are generally large geometric shapes, the zones 60 may be other shapes or relative sizes.

FIG. 13 provides a schematic illustration of one embodiment of creating different zones 60 of tension in a suspension member 10. The suspension member 10 is a continuous web of fabric 63 without a break. In the illustrated embodiment, the warp yarns 26*a* are tensioned into two zones 60, and thereafter, bonded to maintain the different tensions in each zone. More specifically, the first zone 60*a* of the suspension member 10 includes a first series of warp yarns 80*a* that are tensioned to a first tension and the second zone 60 of the suspension member 10 includes a second series of warp yarns 80*b* that are tensioned to a second tension that is different from the first tension. Heat is then applied to the suspension member 10 in order to fix the dual tensions of the suspension member 10. In the illustrated schematic, the suspension member 10 is heated along a heating and bonding strip 64 in order to fix the tension of the suspension member 10 with the two different zones 60 of tension. Specifically, when heat is applied to the suspension member 10, the yarns 26 will bond together and maintain the desired tension by inhibiting the yarns 26 to move relative to one another.

In other embodiments, any number of zones may be created, and different numbers of warp yarns 80*b* may be included in each zone. For example, in some embodiments, the suspension member 10 may include three or more zones. The zones may have similar widths and be formed from similar numbers of warp yarns 80*b*, or may have different widths and be formed from different numbers of warp yarns 80*b*. Additionally, some of the zones may be tensioned to have similar stiffnesses. For example, the suspension may include a first zone having a first stiffness, a second zone having a second stiffness (different than the first stiffness), and a third zone having the first stiffness. Alternatively, the suspension may include a first zone having a first stiffness, a second zone having a second stiffness (different than the first stiffness), a third zone having a third stiffness (different than the first and second stiffnesses), and a fourth zone having the first stiffness.

The illustrated zones are generally embodied as stripes along a length of the suspension member 10. In other embodiments, the zones may be formed as discrete areas on the suspension member 10. For example, after a desired length (e.g., 1 inch, 6 inches, 1 foot, 1 yard, etc.) of warp yarns 80*b* in a particular zone is tensioned and heated, the tension may be changed and/or the heat may be removed for another length of warps yarns 80*b* in that same zone. Such an arrangement may be used to create rectangular zones or, for example, a checkerboard-type pattern. Other shapes and patterns may also be achieved by changing which warp yarns 80*b* are grouped together under a certain tension, moving or altering heating elements, and/or using screes on the heating elements.

Method of Tensioning the Suspension Member

The bonding unit 40 may fix the tension of the suspension member 10 or create different zone 60 of tension by applying heat to the suspension member 10 after the suspension member 10 is pre-tensioned to a desired tension prior to entering the bonding unit 40. The suspension member 10 may be tensioned during the various steps in the method 500 of creating a zoned suspension member 10, including steps 510, 515, 520, and 525. Thereafter, the bonding unit 40 may be used to fix the tension of the suspension member 10. Below are some examples of how to create tension. In the examples, each yarn may be tensioned a different amount, or groups of yarn may be tensioned together. Some of the examples of tensioning provided herein may be used during multiple steps. Different combinations of tensioning may be used during the method 500.

FIGS. 14-16 illustrate example methods of creating tension during warp take-off (step 510). As described above, the warp yarns 26*a* are stored on the feeder 28. The feeder may include a creel, a plurality of spools 32, or warp beams, of warp yarns 26*a* supported on a rack 30, a beam that feeds the warp yarns 26*a*, or any other method of feeding the warp yarns 26*a* during warp take off. The warp yarns 26*a* are fed in a first direction 36, from the spools 32 towards a loom 34. The spools 32 holding the warp yarns 26*a* that are fed towards the loom 34 during warp take-off (step 510) may be adjusted in order to control the tension of the warp yarns 26*a*. In particular, the diameter of the spools 32, the weight of the spools 32, and the friction applied to the spool 32 may be adjusted to some or all of the spools 32 on the rack 30 in order to control the tension of the warp yarns 26*a* being fed towards the loom 34.

Figure 14A:
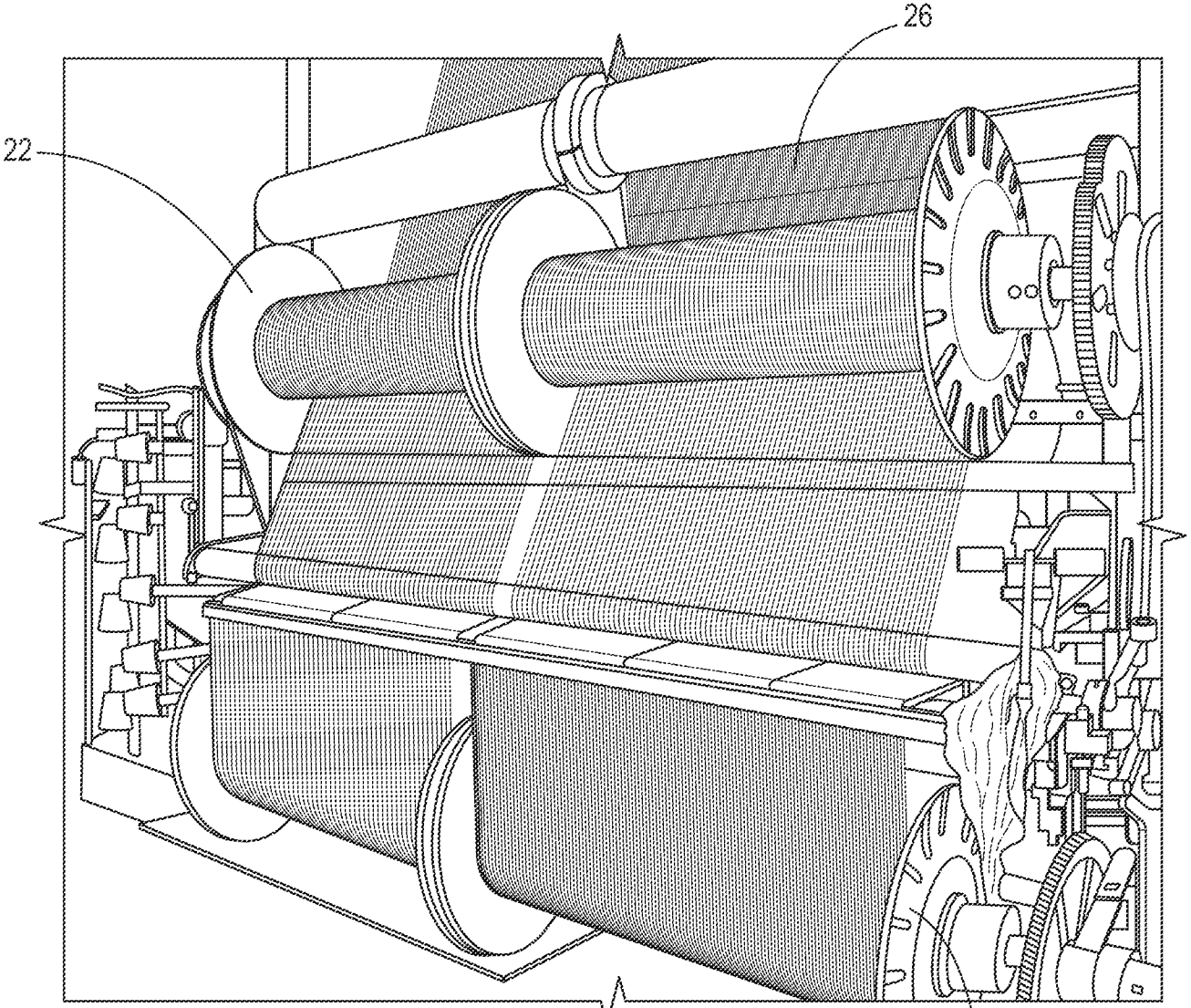
FIG. 14A illustrates a method of creating tension in yarns during warp take off according to one embodiment.
Figure 14B:
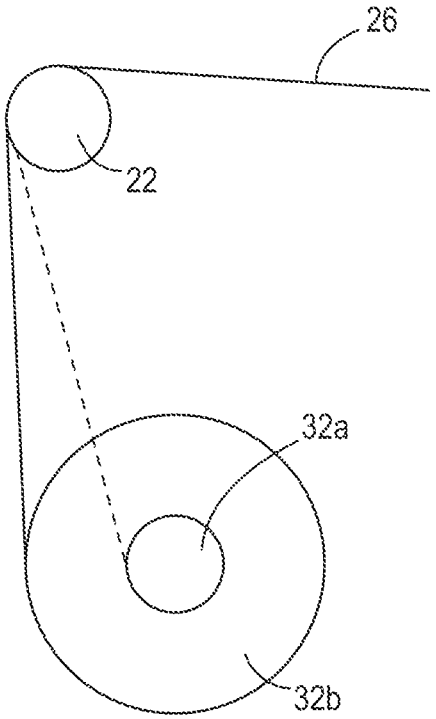
FIG. 14B is a schematic illustration of the method of creating tension of FIG. 14A.

Referring to FIGS. 14A AND 14B, the tension of the yarns 26 may be adjusted during warp take-off by using spools or beams (spools and beams identified generally as 32) of different sizes (i.e., different diameters). Decreasing the diameter of the spool 32 will increase tension of the yarns 26, and contrarily, increasing the diameter of the spool 32 will decrease the tension of the yarns 26. Similarly, the tension of the yarns 26 may be adjusted during warp take-off by using spools 32 of different weights. Increasing the weight of the spool 32 will increase the tension of the yarn 26, while decreasing the weight of the spool 32 will decrease the tension of the yarns 26. In some embodiments, the spools 32 may be of the same diameter and/or weight in order to create a uniform tension across all yarns 26. In other embodiments, these spools 32 can have varying diameters and/or weights in order to create different tensions in different zones 60 of the suspension member 10. In some embodiments, each zone 60 would have its own source of tension.

Figure 15A:
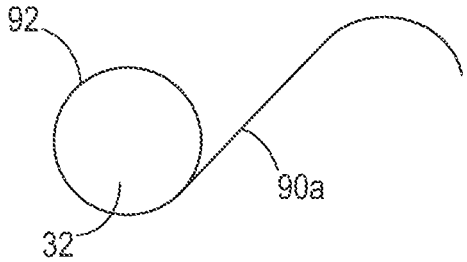
FIG. 15A is a method of creating tension in yarns during warp take off according to one embodiment.
Figure 15B:
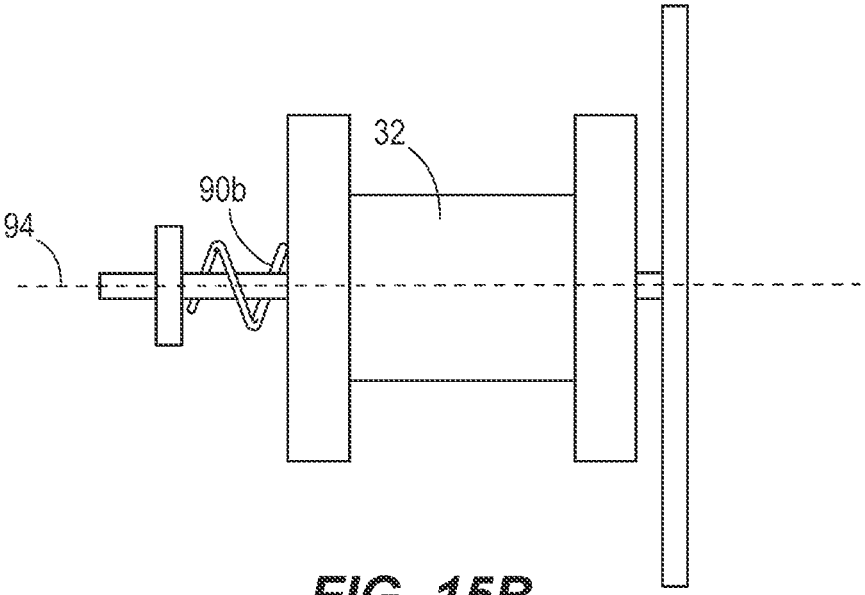
FIG. 15B is a method of creating tension in yarns during warp take off according to one embodiment.
Figure 16A:
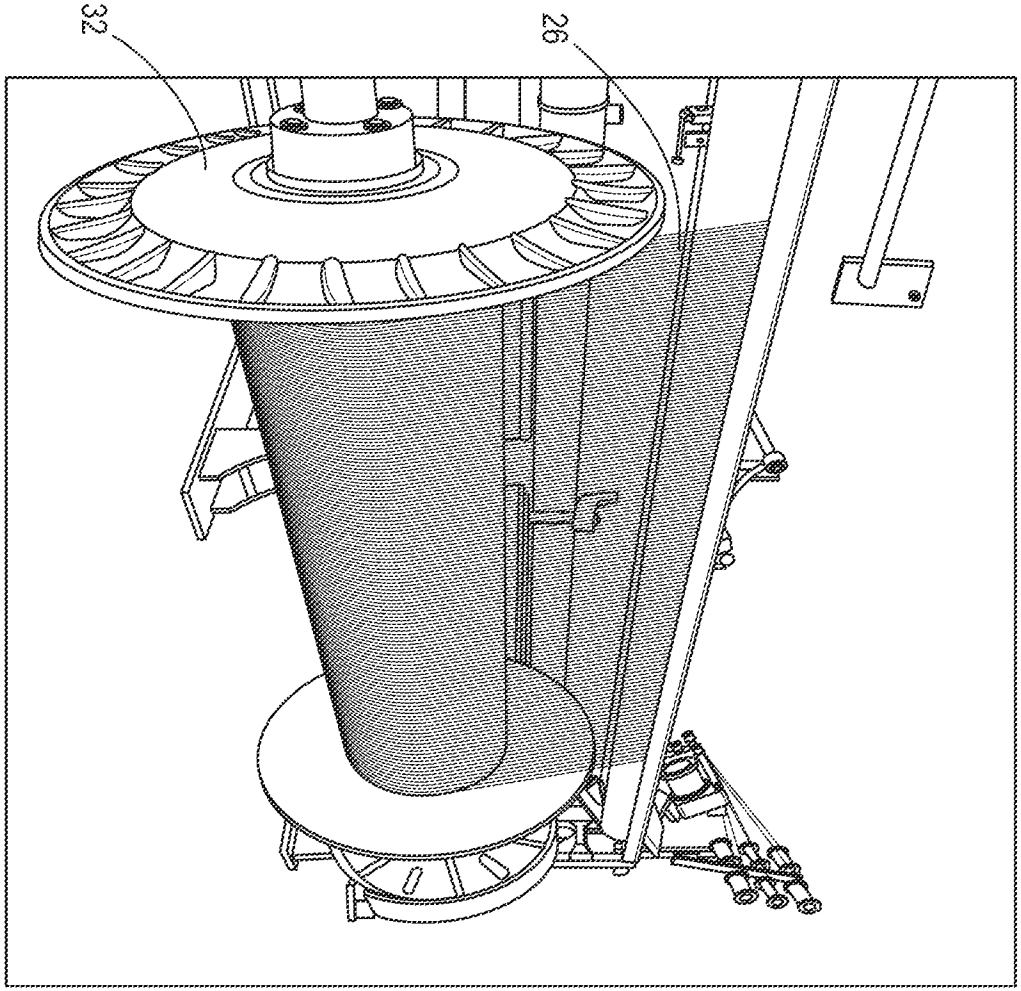
FIG. 16A is a method of creating tension in yarns during warp take off according to one embodiment.
Figure 16B:
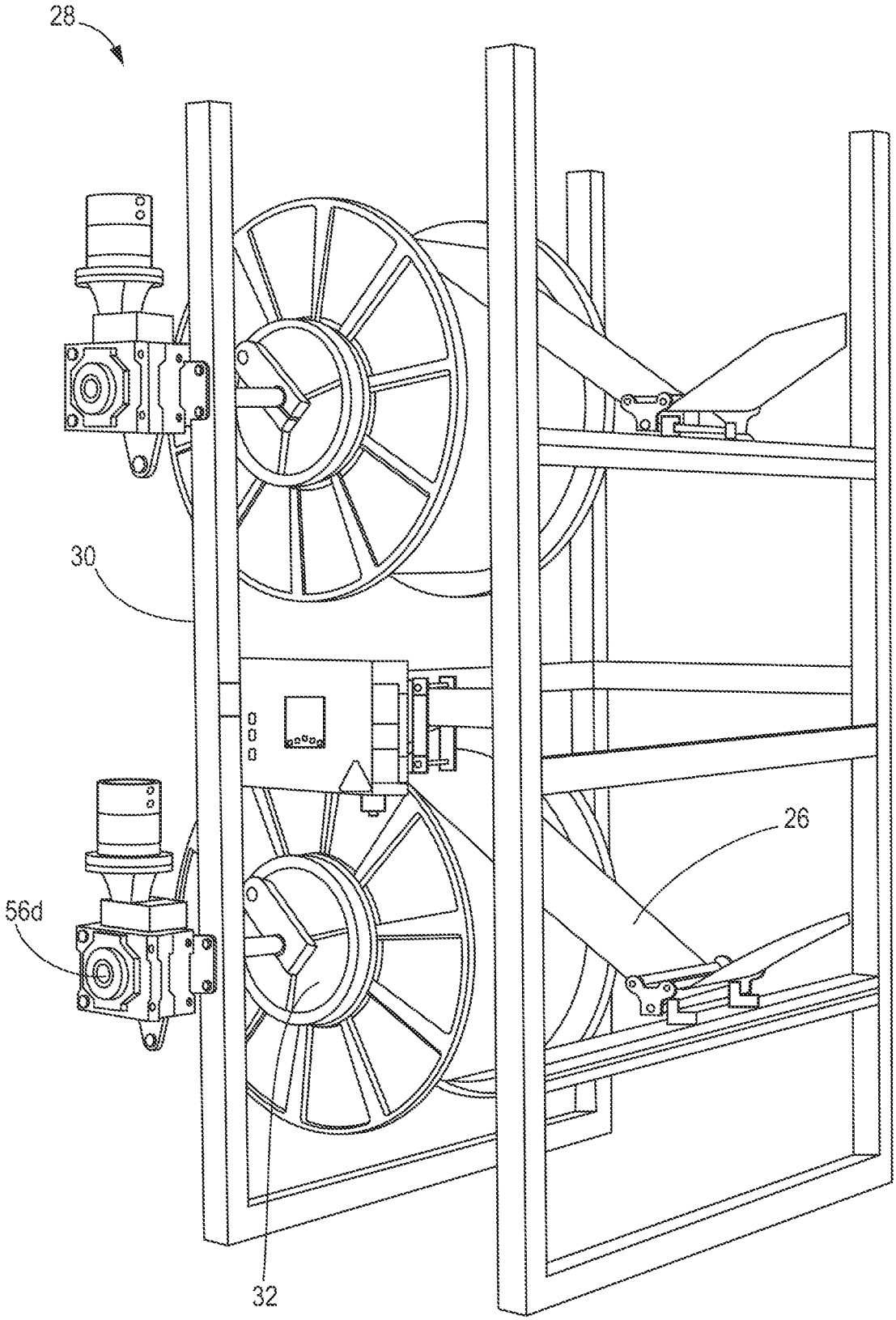
FIG. 16B is a method of creating tension in yarns during warp take off according to one embodiment.
Figure 16C:
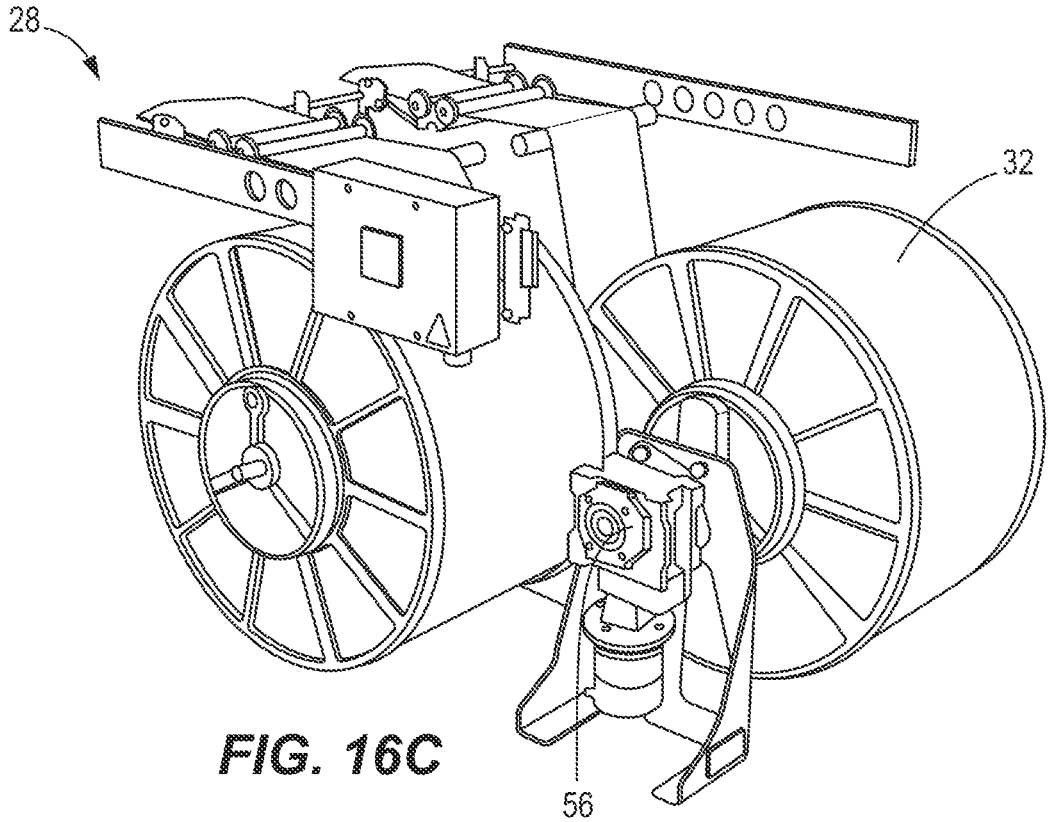
FIG. 16C is a method of creating tension in yarns during warp take off according to one embodiment.
Figure 16D:
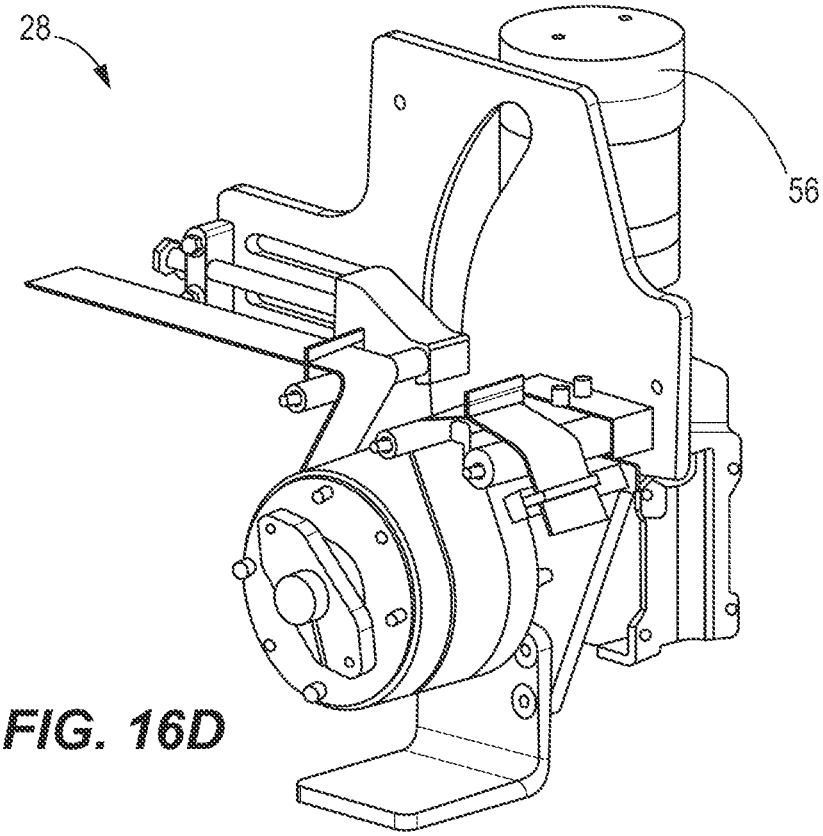
FIG. 16D is a method of creating tension in yarns during warp take off according to one embodiment.

Additionally, a frictional force may be applied to the spool 32 to control the tension of the yarns 26 by making it easier or more difficult for the spool 32 to rotate. For example, in the embodiment illustrated in FIGS. 15A and 15B, a spring 90 may be used to apply a force on the spool 32. For example, as shown in FIG. 15A, the spring force may be applied to the rim 92 of the spool 32 by a beam spring 90*a*. Alternatively, as shown in FIG. 15B, or in addition, a spring force may be applied to the central axis 94 of the spool 32 by a helical spring 90*b*. More specifically, the spool is compressed 32 along the central axis 94. Increasing the friction of the spool 32 will increase the tension of the yarns 26, while decreasing the friction will reduce the tension of the yarns 26. The same or a similar frictional force may be applied to all of the spools 32 in order to create a uniform tension of the yarns 26, while in other embodiments the frictional force applied to each spool 32 may differ in order to create different zones 60 of tension.

Furthermore, as shown in FIGS. 16A-16D, the tension of the yarns 26 may be controlled by utilizing motors 56 to drive the axels of the spools 32, and thereby control the speed of rotation of the spools 32. By rotating the spools 32 at different speeds, the yarns 26 on each spool 32 may have a different tension. Again, in some embodiments, it may be desirable to have all of the yarns 26 at an equivalent tension.

Figure 17:
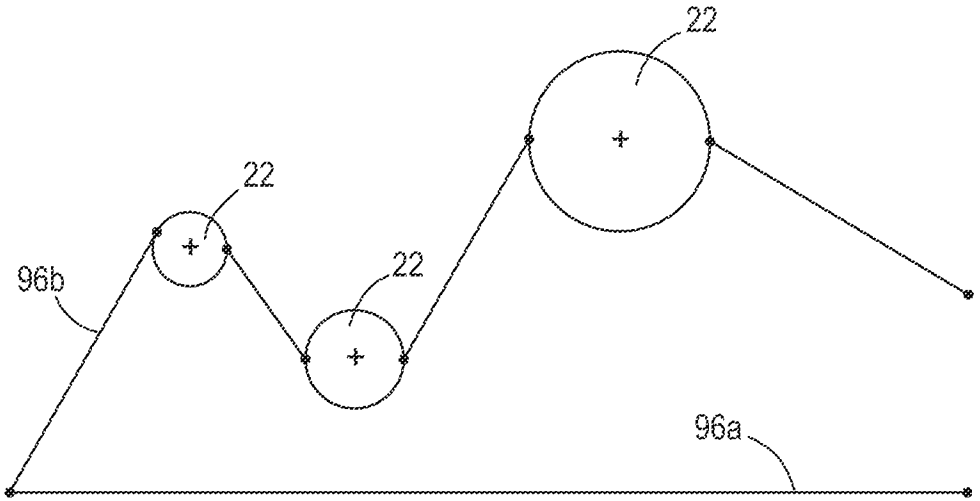
FIG. 17 illustrates a method of creating tension in yarns between warp take-off and a loom according to one embodiment.

As previously mentioned, the yarns 26 may also be tensioned prior to entering the loom 34 during the pre-loom 34 tensioning step (step 515). FIGS. 17-24 provide various examples of methods of tensioning the yarns 26 during the pre-loom 34 tensioning step (step 515). As shown in FIG. 17, the tension of the yarns 26 may be varied by varying the travel path of the yarns 26 between warp take-off and the loom 34. For example, a first series of yarns 26, 96*a* may have a more direct path between warp take-off and the loom 34, while a second plurality of yarns 26, 96*b* may have a more indirect path between warp take-off and the loom 34. The second plurality of yarns 26, 96*b* would have a long path over a series of rollers. In this instance, the first yarns 26, 96*a* would have a first tension and the second yarns 26, 96*b* would have a second tension that is greater than the first tension. In other words, generally speaking, the more indirect the path between warp take-off and the loom 34, the more tension is applied to the yarn 26.

Figure 18B:
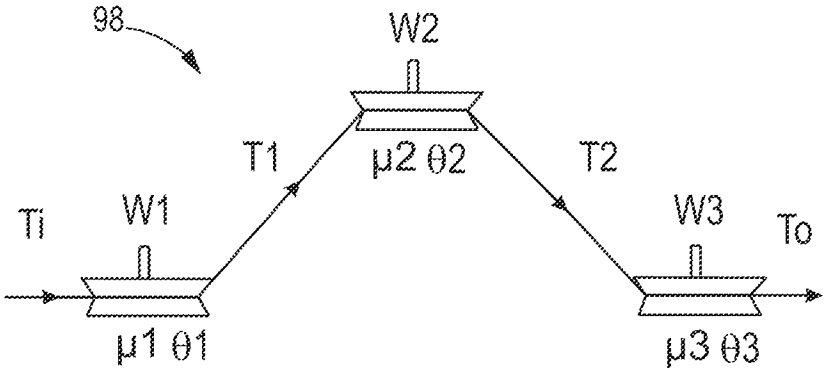
FIG. 18B is a schematic illustration of the tensioning device of FIG. 18A.
Figure 18A:
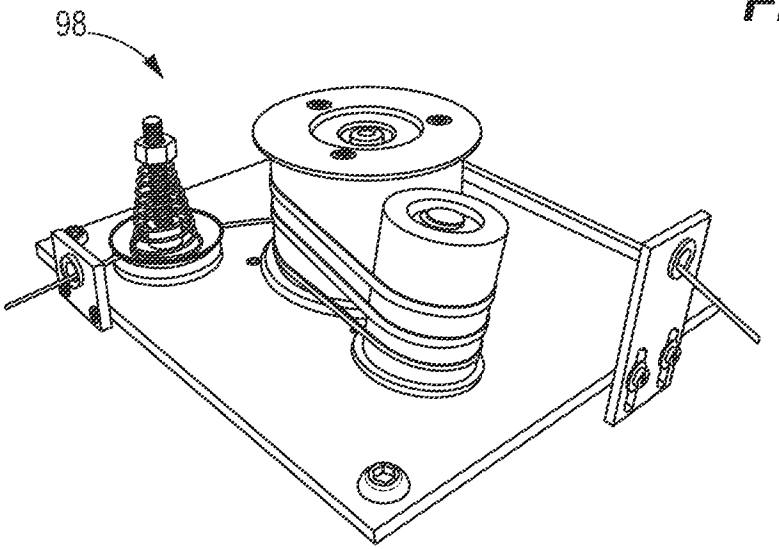
FIG. 18A illustrates a tensioning device according to one embodiment.

Referring to FIGS. 18A-20B, the yarns 26 may be tensioned by using a tensioning device. FIGS. 18A-20B provide various examples of tensioning devices 96 that may be used. As shown in FIGS. 18A-18B, an additive cum multiplicative type tension generator can be used to create tension in yarns 26. The additive cum multiplicative type tensioning devices comprise of both additive and multiplicative elements. The general equation for calculating the output tension in this case is given by:

$$To=[\{(Ti+2\mu W1)\times e\mu\theta 1+vW2\}\times e\mu\theta 2+\mu W3]\times e\mu\theta \quad \text{[Equation 1]}$$

Where:

To=Output Tension

Ti=Input Tension

μ=Coefficient of Friction Between Surfaces

W=Force or Pressure Applied on the Yarn

Θ=Angle of Wrap over the Surface

Figure 19B:
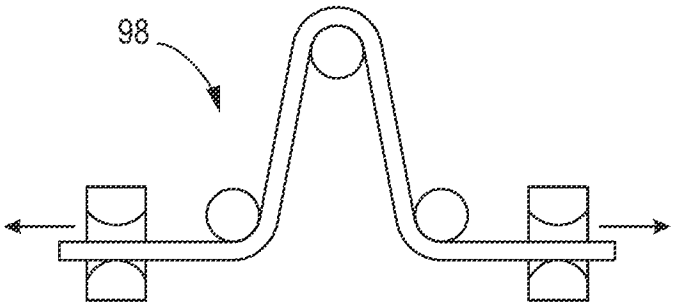
FIG. 19B illustrates a tensioning device according to one embodiment.
Figure 19D:
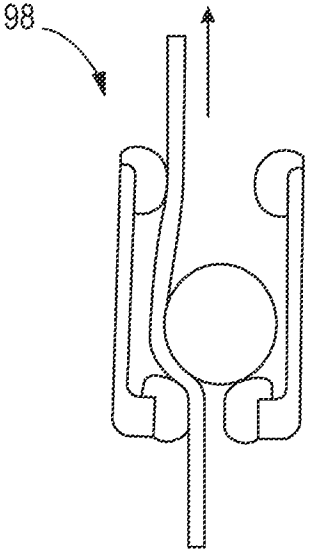
FIG. 19D illustrates a tensioning device according to one embodiment.
Figure 19A:
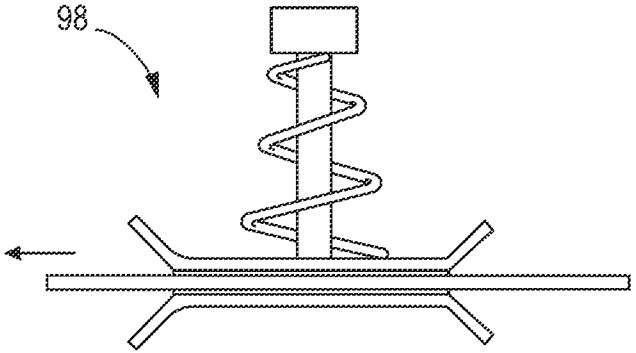
FIG. 19A illustrates a tensioning device according to one embodiment.

FIGS. 19A-19D illustrate self-adjusting type devices which change their settings depending on the output tension. FIG. 19A illustrates a disc tension device. As illustrated, the yarn is passed between the two discs and the yarn is subjected to frictional force with both of the discs. The equation for calculating the output tension is:

$$To=Ti+2\mu W \quad \text{[Equation 2]}$$

Where:

2 μW=Total Frictional Force of the Disc

Figure 19C:
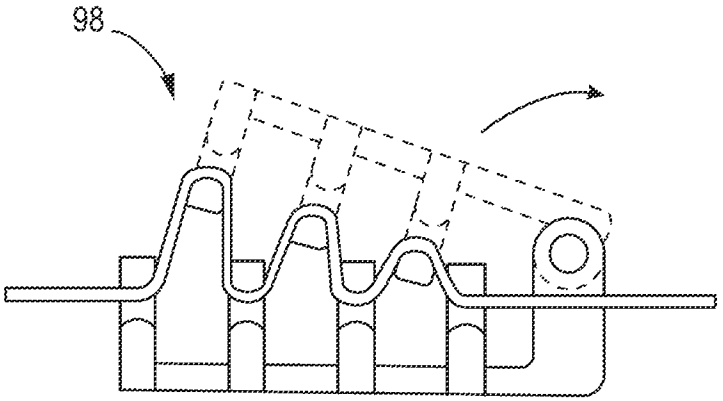
FIG. 19C illustrates a tensioning device according to one embodiment.

FIG. 19B illustrates a post tension device. FIG. 19C illustrates a lever tension device. The upper arm is spring loaded in a clockwise direction. With low output tension, the lever is in the up position (dotted). In this position, the yarn has to run around the guides for an increased wrap angle, which increases the yarn tension. With high output tension, the upper arm moves closer to the lower arm, thereby adding less tension. FIG. 19D illustrates a ball tension device. The ball-tension device also changes the applied tension, to some degree when the output tension changes. Higher yarn tension lifts the ball high, for less wrapping, or reduces the pinching force between the ball and the guide. In general, these devices are simple and "low cost." Their major drawbacks include scuffing of the yarn, tension variations depending on the friction coefficient, and tension spikes with irregular yarns and knots.

Figure 20A:
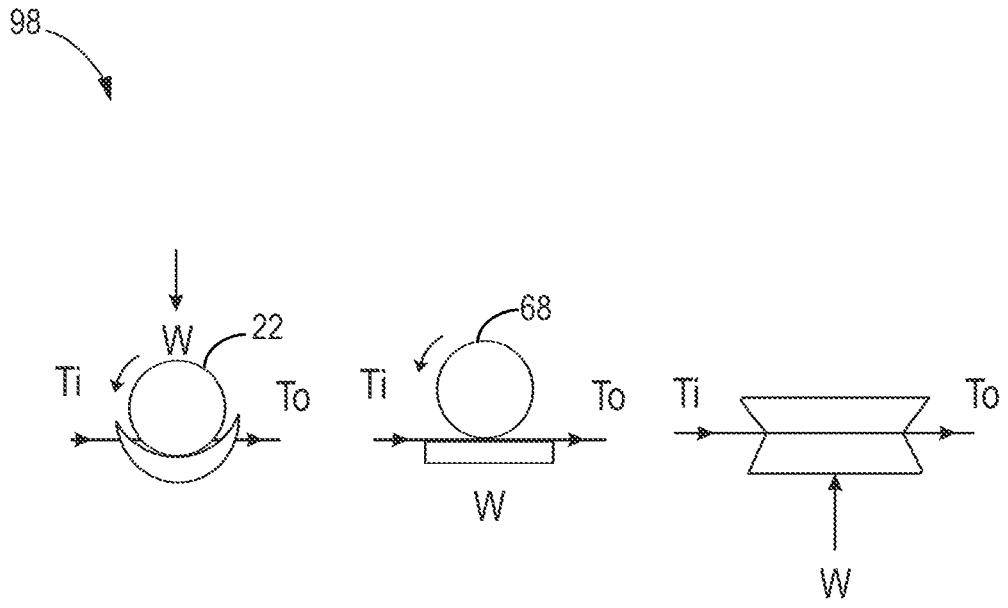
FIG. 20A illustrates a tensioning device according to one embodiment.

FIG. 20A illustrates additive type tension generators. The additive type tension devices can include a ball 68 or a roller 22. Additive type tension devices add a constant tension to the input tension. An example of an additive type tension device is a disk-tension device. To calculate the added tension due to a disk-tension device, Equation 2 can be applied.

Figure 20B:
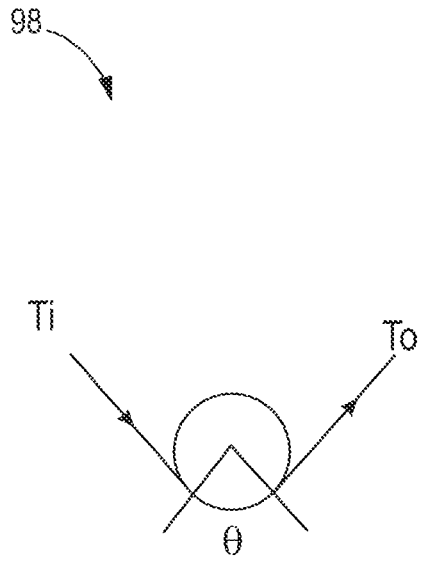
FIG. 20B illustrates a tensioning device according to one embodiment.
Figure 20C:
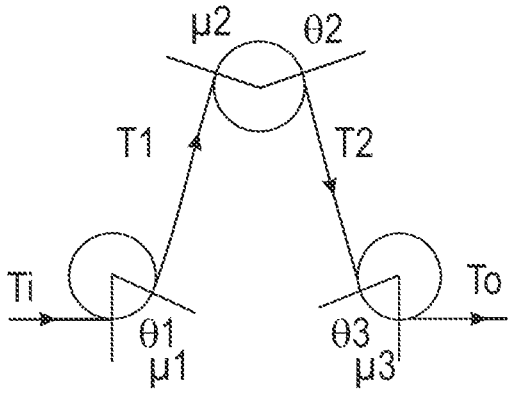
FIG. 20C illustrates a tensioning device according to one embodiment.

FIG. 20B and FIG. 20C illustrate multiplicative type tension generators. Multiplying type tension devices operate by multiplying the incoming tension. The formula used for calculating the output tension in this case, is called the "belt-formula." The general equation for calculating the output tension in this case is given by:

$$To=Ti\times e\mu\theta \quad \text{[Equation 3]}$$

Figure 21:
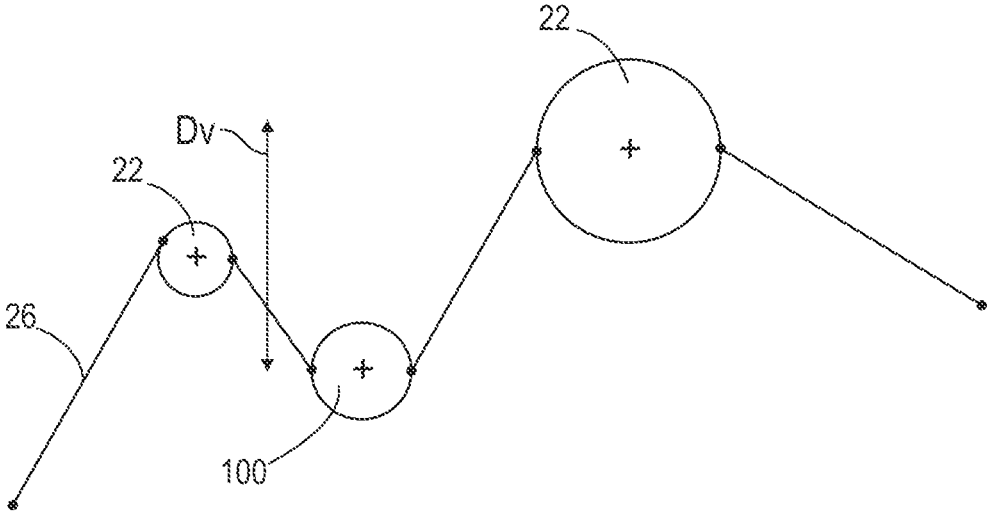
FIG. 21 illustrates a method of creating tension in yarns between warp take-off and a loom according to one embodiment.

Additionally, as shown in FIG. 21, a gravity roller 100 or other weight may be used to create tension in the yarns 26. In the embodiment shown in FIG. 21, a weighted roller 100 is positioned on the yarns 26 between two transport rollers 22 and applies a tension to the yarns 26 as they travel between the two transport rollers 22. The roller 22 is free to move in the vertical direction Dv and to apply tension to the warp yarn via the effect of gravity.

Figure 22:
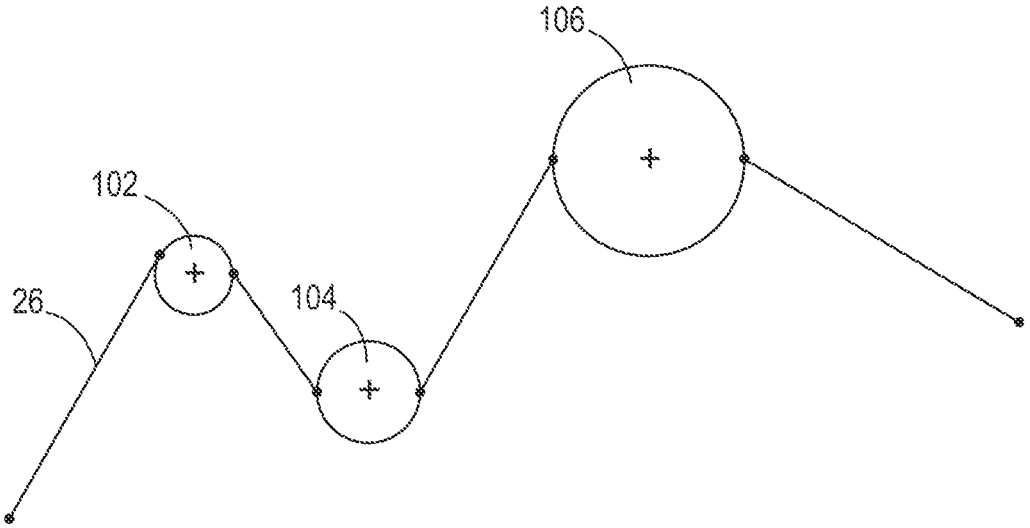
FIG. 22 illustrates a method of creating tension in yarns between warp take-off and a loom according to one embodiment.

Referring to FIG. 22, tension may also be controlled by adjusting the friction on a roller. The greater the friction on the roller 22 is, the greater grip causing tension on the yarn 26 will be. Contrarily, a roller 22 with low friction will have increased slippage, resulting in less tension. For example, in the embodiment shown in three types of rollers 22 along a path including a chrome roller 102, a rough surface roller 104, and a rubber roller 106. The rubber roller 106 will have increased friction relative to the chrome roller 102, and therefore, the rubber roller 106 will create greater tension in the yarns 26 than the chrome roller 102. The tension created by the rough surface roller 104 will depend on the specific roughness.

Figure 23:
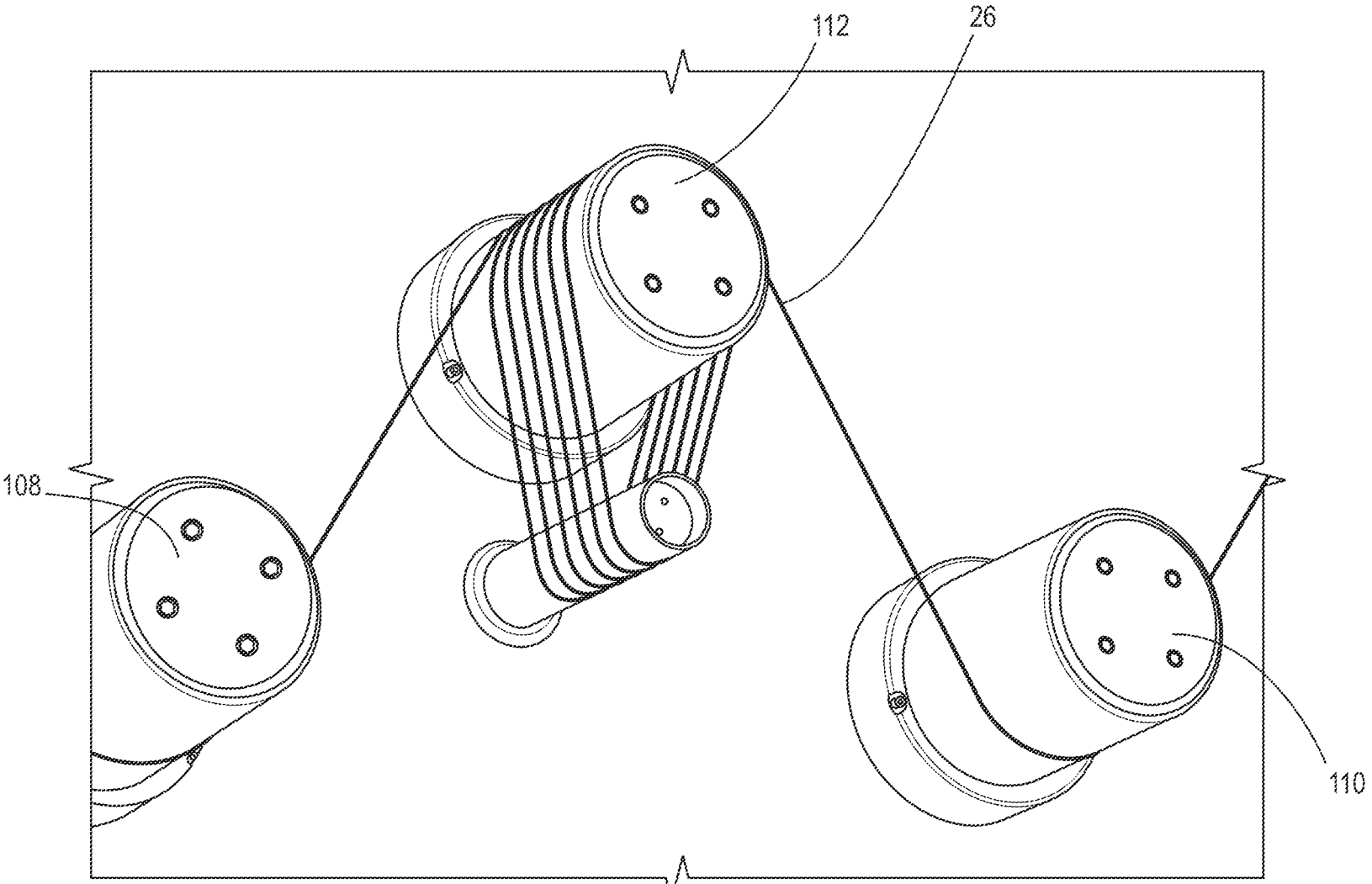
FIG. 23 illustrates a method of creating tension in yarns between warp take-off and a loom according to one embodiment.

Similarly, as shown in FIG. 23, the tension on the yarns 26 may be controlled by varying the speeds of the rollers 22. For example, in the illustrated embodiment, first and second rollers 108, 110 are driven at the same speed, while a third roller 112 is driven at a different speed. This speed difference will result in increased tension of the yarns 26. The greater the differences in speed, the greater the tension on the yarns 26.

Figure 24A:
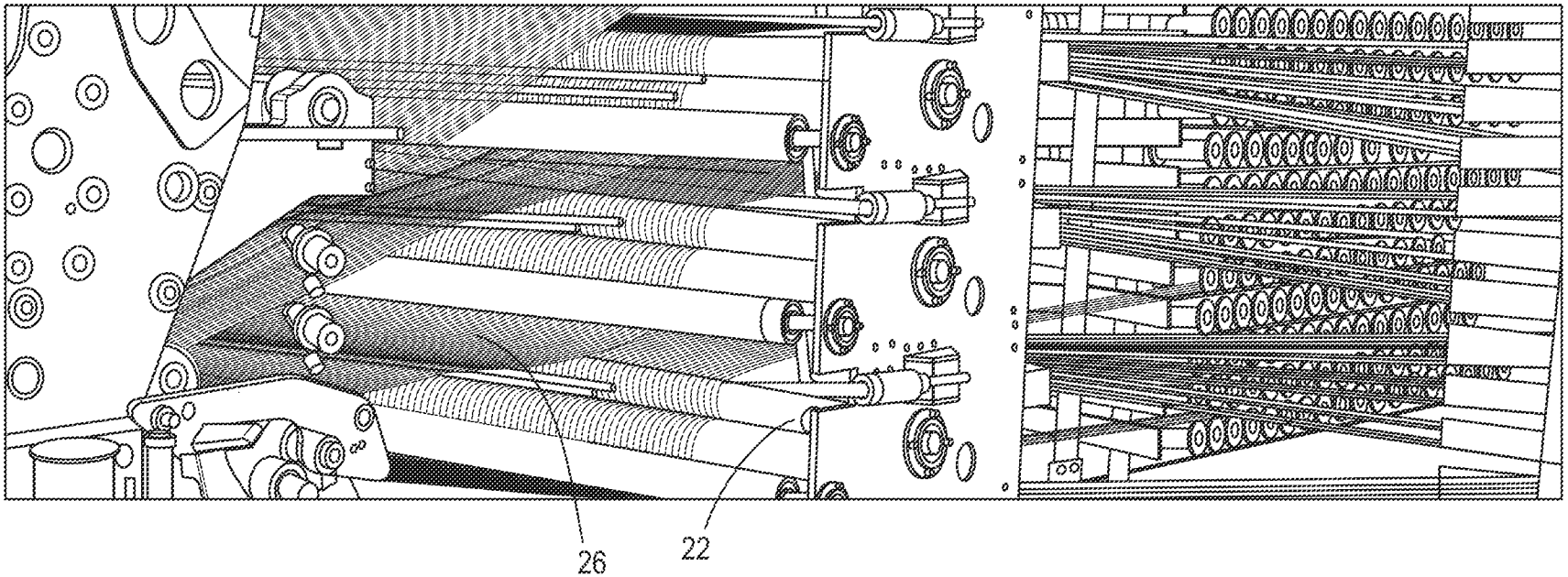
FIG. 24A illustrates a method of creating tension in yarns between warp take-off and a loom according to one embodiment.
Figure 24B:
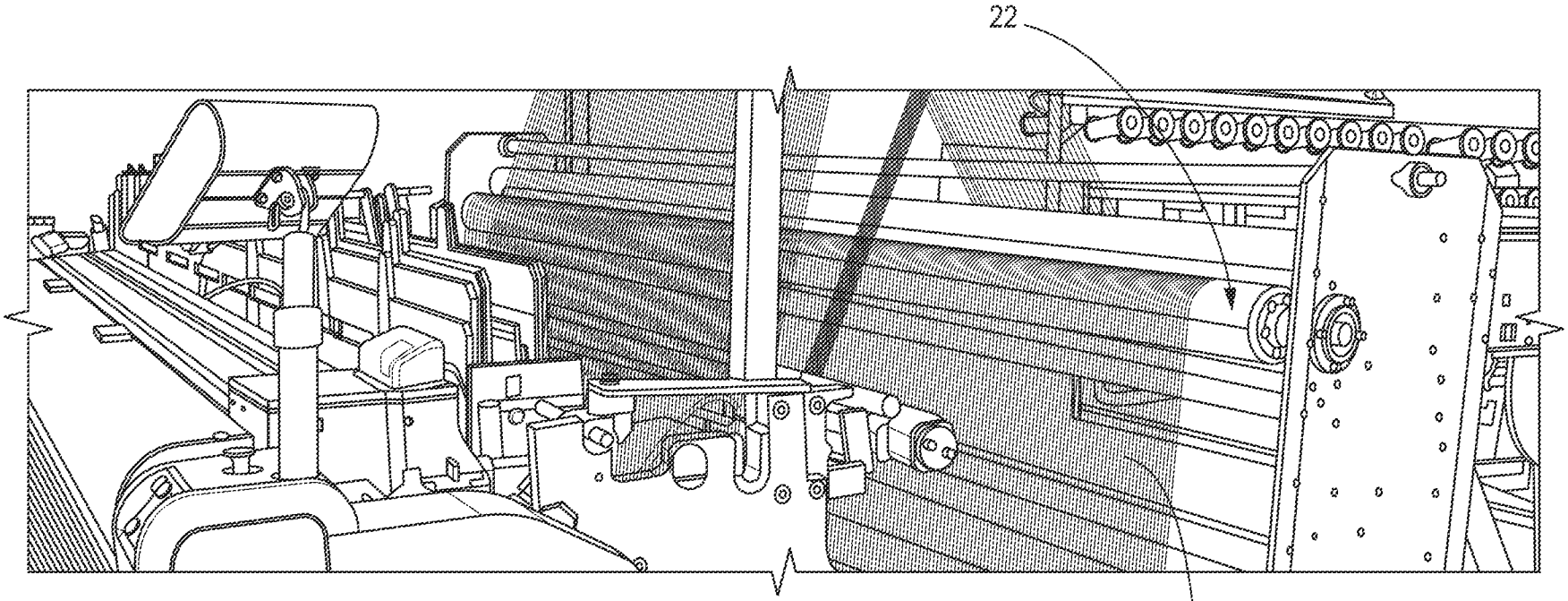
FIG. 24B illustrates a method of creating tension in yarns between warp take-off and a loom according to one embodiment.
Figure 25:
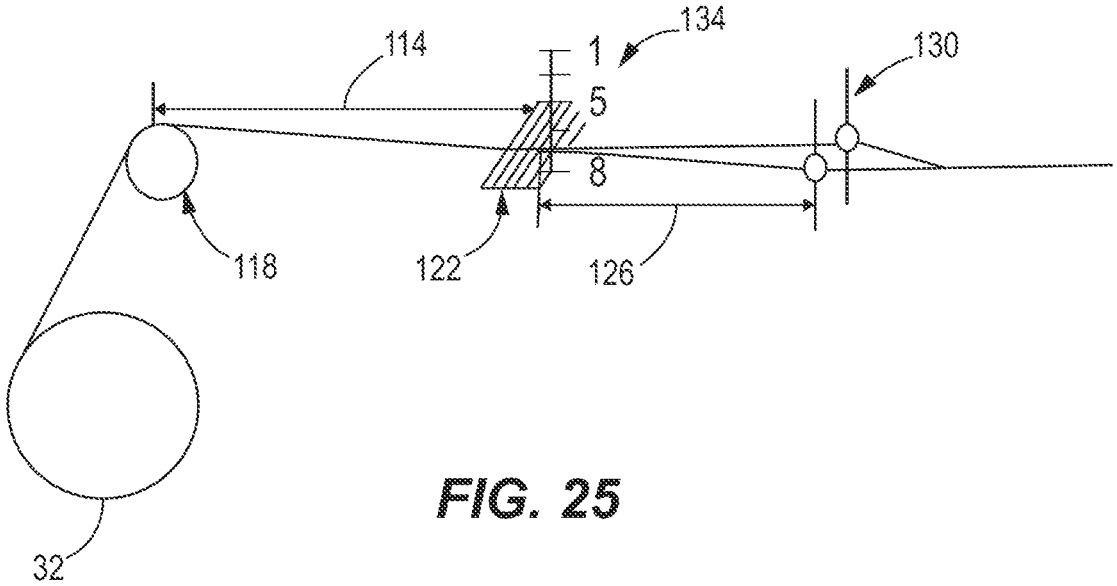
FIG. 25 illustrates method of creating tension in yarns using loom components.
Figure 26:
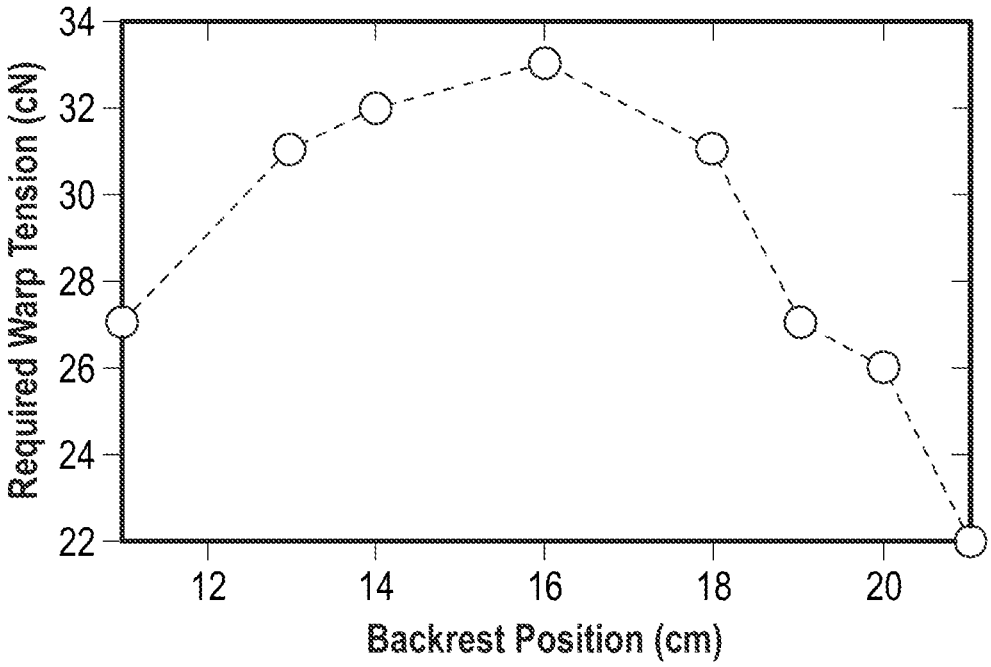
FIG. 26 is a graph illustrating an effect of a backrest position in the method of creating tension of FIG. 25.

Another method of tensioning the yarns 26 between warp-take-off and the loom 34 is to use a pre-heald tensioning technique, as shown in FIGS. 24A and 24B. Pre-heald tensioning is a method of tensioning the yarns 26, which occurs immediately before entering heald frames in a loom 34. Often these systems are attached to or a part of a loom 34. Also tension can be modified by yarn path, eye board constriction or other known methods common in industry.

In addition or in the alternative to tensioning the yarns 26 along the path between warp take-off and the loom 34, the yarns 26 can be tensioned using the loom 34 components themselves. FIGS. 25-28 provide various method of tensioning the yarns 26 with the loom 34 components. With the advancement of time, the beam 32 diameter is decreased and the angle of lap increases. The depicted loom settings include a backrest roller position 114, dropper height 134 and dropper depth 126. The change in loom settings will cause variation in warp tension. For example, if backrest position 114 or backrest height change then the warp tension also changes. For all settings, like the warp tension follow a specific pattern.

A backrest roller 118 is a crucial part of a weaving machine. Proper positioning of the backrest roller may give good quality of fabric and help achieve good efficiency. An upper position of the backrest roller 118 increases tension of a lower shed of the warp yarns and a lower position of the backrest roller 118 increases the tension of an upper shed of the warp yarns. Several looms were analyzed in order to establish a relationship between backrest position and tension. The effect of the backrest position is influenced by the position of a dropper line 122. At the nearest backrest position (i.e. 11 cm to 16 cm at Leonardo loom) increasing backrest position will put the dropper line 122 at the middle of the warp yarn so more tension will be required for the warp yarn to be at a proper level. For the higher backrest position (i.e. above 17 cm at Leonardo loom) where the dropper line 122 is kept in a constant position from the backrest (i.e. the dropper line 122 comes relatively closer to the backrest) then the backward movement of the backrest roller 118 will reduce the required tension.

Figure 27:
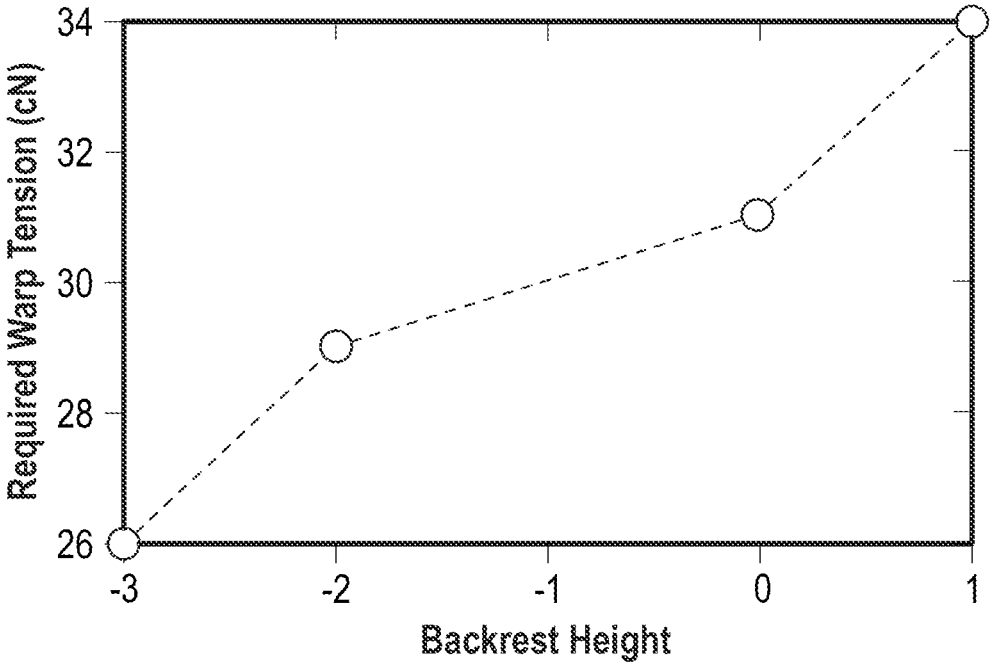
FIG. 27 is a graph illustrating an effect of a backrest height in the method of creating tension of FIG. 25.

The effect of backrest height is illustrated in FIG. 27. Here the digit having a negative sign indicates downward position and the digit without sign indicates upward position of the backrest. The required warp tension will be low when the backrest is moved downward but it increases with the increase of backrest height.

Figure 28:
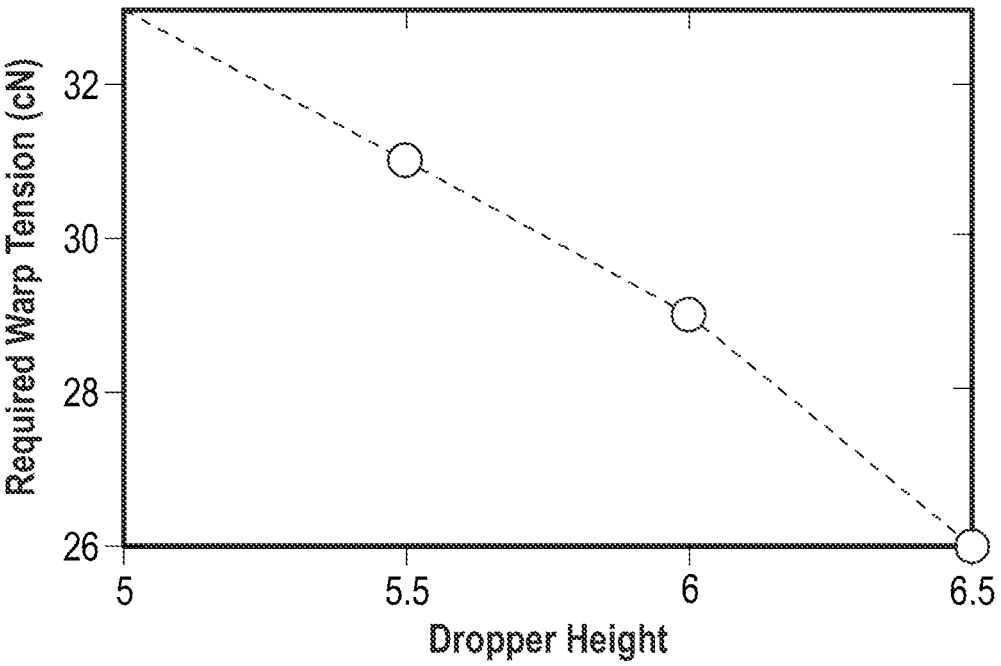
FIG. 28 is a graph illustrating an effect of a dropper height in the method of creating tension of FIG. 25.

The effect of dropper height 134 is illustrated in FIG. 28. With the increase of dropper height (lifting the dropper line) warp tension tends to decrease provided that the dropper line is situated at the middle of the warp. If the dropper line is situated closer to a heald frame 130 then this effect will be nullified by the effect of dropper position. It is observed that with the increase of dropper height the tension reduces if the dropper lies at the middle of the warp. Because increase of dropper height means lifting of the dropper, the downward tension imposed on the yarn will decrease.

The embodiments described above and illustrated in the figures are presented by way of example only and are not intended as a limitation upon the concepts and principles of the present invention. As such, it will be appreciated that various changes in the elements and their configuration and arrangement are possible without departing from the spirit and scope of the present invention. Various features and advantages of the invention are set forth in the following claims.

What is claimed is:

1. A method of manufacturing a suspension member, the method comprising:

providing a first set of yarns and a second set of yarns;

combining the first set of yarns and the second set of yarns to form the suspension member;

tensioning a first portion of the first set of yarns and the second set of yarns to a first tension;

tensioning a second portion of the first set of yarns and the second set of yarns to a second tension that is different than the first tension; and at least partially bonding the first portion of the first set of yarns and the second set of yarns together by heating the suspension member to form a first zone of the suspension member having the first tension; and at least partially bonding the second portion of the first set of yarns and the second set of yarns together by heating the suspension member to form a second zone of the suspension member having the second tension.

2. The method of claim 1, wherein the combining the first set of yarns and the second set of yarns includes feeding the first set of yarns and the second set of yarns through a loom and weaving the second set of yarns through the first set of yarns.

3. The method of claim 2, further comprising tensioning a portion of the first set of yarns before the combining the first set of yarns and the second set of yarns.

4. The method of claim 2, further comprising tensioning a portion of the first set of yarns during the combining the first set of yarns and the second set of yarns.

5. The method of claim 1, wherein bonding the first and second portions includes applying different amounts of heat to the first zone of the suspension member and to the second zone of the suspension member.

6. The method of claim 1, wherein bonding the first and second portions includes heating the suspension member in a continuous manner.

7. The method of claim 1, wherein bonding the first and second portions includes heating the suspension member in a discontinuous manner.

8. The method of claim 1, wherein bonding the portion of the first set of yarns and the second set of yarns together includes moving a heating element towards and away from the suspension member to control an amount of heat applied to the suspension member.

* * * * *